US008286619B2

(12) United States Patent
Mihaljevic

(10) Patent No.: US 8,286,619 B2
(45) Date of Patent: Oct. 16, 2012

(54) BALL PROJECTING AND TRAINING APPARATUS AND METHOD OF USE

(76) Inventor: Shane P. Mihaljevic, St. Louis, MO (US)

( * ) Notice: Subject to any disclaimer, the term of this patent is extended or adjusted under 35 U.S.C. 154(b) by 331 days.

(21) Appl. No.: 12/793,232

(22) Filed: Jun. 3, 2010

(65) Prior Publication Data

US 2010/0307470 A1 Dec. 9, 2010

Related U.S. Application Data

(60) Provisional application No. 61/217,900, filed on Jun. 5, 2009.

(51) Int. Cl.
*F41B 3/03* (2006.01)

(52) U.S. Cl. ..... 124/16; 124/36

(58) Field of Classification Search ..... 124/7, 16, 124/17, 36

See application file for complete search history.

(56) References Cited

U.S. PATENT DOCUMENTS

| | | | | |
|---|---|---|---|---|
| 1,912,360 | A | | 6/1933 | Blanchard |
| 3,128,752 | A | | 4/1964 | Andersen |
| 3,552,371 | A | | 1/1971 | Kahelin |
| 3,722,494 | A | | 3/1973 | Slevin |
| 3,760,787 | A | * | 9/1973 | Kahelin ..... 124/16 |
| 3,892,217 | A | | 7/1975 | Raty |
| 4,122,822 | A | | 10/1978 | Schweiwiller |
| 4,271,813 | A | | 6/1981 | Rowe |
| 4,345,577 | A | | 8/1982 | Andersson |
| 4,409,953 | A | | 10/1983 | Kennedy et al. |
| 4,995,371 | A | * | 2/1991 | Kuizinas ..... 124/7 |
| 5,249,564 | A | | 10/1993 | Peachey |
| 5,465,978 | A | | 11/1995 | Magnone et al. |
| 5,660,386 | A | | 8/1997 | Krieger |
| 5,911,214 | A | | 6/1999 | Andrews |
| 6,129,076 | A | | 10/2000 | Powell et al. |
| 6,505,617 | B1 | | 1/2003 | Neuman |
| 6,546,923 | B2 | | 4/2003 | Erickson |
| 6,647,975 | B2 | | 11/2003 | Whitfield |
| 7,066,846 | B2 | | 6/2006 | Horkan |
| 7,415,976 | B1 | | 8/2008 | Powell |
| 2008/0032828 | A1 | | 2/2008 | Alger |

* cited by examiner

*Primary Examiner* — John Ricci
(74) *Attorney, Agent, or Firm* — Kevin L. Klug

(57) ABSTRACT

A ball projecting and training apparatus and method of use having a base, a throwing arm, an adjustable ball mount on said throwing arm, and one or more energy storage elements connected between an end of the throwing arm and an accelerator. The ball mount pivots in a direction parallel with, perpendicular to, or a combination thereof relative to the throwing arm and also locks to provide repeatable trajectories and spins. The accelerator provides additional energy to the ball when depressed by a user. A release holds the throwing arm when the apparatus is cocked and allows a user to launch a ball when desired.

19 Claims, 36 Drawing Sheets

BALL PROJECTING AND TRAINING APPARATUS AND METHOD OF USE

This application claims priority of U.S. Provisional Patent Application No. 61/217,900, filed Jun. 5, 2009, entitled Ball Projecting and Training Apparatus and Method of Use.

BACKGROUND OF THE INVENTION

The art of the present invention relates to game or ball training equipment in general and more particularly to an apparatus and method of use which launches a soccer or other type of ball and provides a plurality of user controllable ball pitches, distances, trajectories, spins, angles, cants, or swerves in a compact and portable form. The present art is also useful with volleyball, American football, rugby, baseball, softball, futsal, and cricket. The apparatus and method of use is especially useful for aiding, improving, and developing the skills of a soccer player, regardless of his or her skill level. The apparatus and method of use improves player and goalie shooting and trapping skills by providing ball projections which mimic real game situations. The present art may be utilized as an ultimate finishing solution for players desiring to hone their technique. The term "soccer" is typically utilized within North America, South Africa, Japan, Australia, New Zealand and Zimbabwe to describe the game more formally known as "Association Football" in other countries around the world. The game is also known as Football, Futbol, or Footy/Footie.

The present art accepts, accelerates, and launches a ball with user desirable motion characteristics, such as linear acceleration, angular acceleration, spin, or a combination thereof. The apparatus provides adjustments for elevation, yaw, pitch, and spin which affect the exiting ball trajectory. When adjusted as desired, the exiting ball trajectory or path is highly repeatable.

Soccer players and goalies, as well as other types of game players which interface with a ball, must master a plurality of skills for effective play, including but not limited to ball control, ball possession, ball passing, ball blocking, and ball shooting. As understood within the soccer arts, players utilize their feet, legs, chest, shoulder, and head to receive, control, and redirect the ball with goalies utilizing their hands in addition to the aforesaid. The aforesaid skills are mastered through repetitive training whereby an unconscious muscle memory is created within the player and allows the player to react instantaneously when a ball arrives at any specific angle, velocity or speed, or trajectory. During training, it is essential that the moving ball or ball service be presented in a repeatable fashion whereby said player may develop said muscle memory. The aforesaid unconscious muscle memory is also found within a plurality of other sports including but not limited to baseball, basketball, football, volleyball, and tennis.

The present art apparatus and method of use allows user adjustment whereby a repeatable ball service is provided for a plurality of ball types, including but not limited to soccer balls, volleyballs, footballs, baseballs, softballs, rugby balls, cricket balls, and basketballs. The apparatus provides user adjustability for ball velocity, exiting elevation, trajectory, angular velocity or yaw, and spin. Ball velocity and trajectory are further quickly adjustable or user adjustable on the fly via a foot actuated accelerator or power pedal. The unique ball mount of the present art has the ability to adjust the spin on a vertical axis and at the same time on a horizontal axis. The vertical axis control is secured by two serrated or grooved mating and adjustable locking disks on a left and right side of a ball mount. This adjustment controls the spin and height of the ball thrown and also dictates at what angle the ball projects on the vertical axis. The ball mount is also formed in such a fashion as to control left to right spin and or curve of the ball being thrown. This aspect of the apparatus also dictates the amount of side spin a user can put on the ball. When both of the aforesaid features are used in conjunction with one another, a bending dip may be placed upon the ball. The dip is as seen on free kicks and placed shots and also on corner kicks. The unique features of the present apparatus are especially useful for goalie training such as bending a ball around a wall of players and dipping the ball into the goal proximately near the goal.

The apparatus further includes a ball storing and feeding structure which allows quick and easy loading of balls. The method of use allows a player to receive balls at a plurality of angles, velocities, trajectories, and spins whereby the player may develop the desired muscle memory for game play. The apparatus and method of use is especially useful for coaches and trainers whereby a repeatable set of ball angles, velocities, trajectories, and spins may be utilized during a course of player training and to assess the skills of any individual player.

Accordingly, it is an object of the present invention to provide a ball projecting and training apparatus and method of use which is safe and capable of launching a ball in a predictable and repeatable fashion with a plurality of user desirable and adjustable velocities, elevations, trajectories, angular velocities or yaws, and spins.

Another object of the present invention is to provide a ball projecting and training apparatus and method of use which easily allows a player or goalie to improve their shooting and trapping skills by providing ball projections which mimic real game situations.

Another object of the present invention is to provide a ball projecting and training apparatus and method of use which imparts desirable ball motion characteristics, such as linear acceleration, angular acceleration, spin, or a combination thereof and provides adjustments for ball trajectory elevation, yaw, pitch, and spin.

SUMMARY OF THE INVENTION

To accomplish the foregoing and other objects of this invention there is provided a ball projecting and training apparatus and method of use having abase, a throwing arm, and an adjustable ball mount attached with said throwing arm near a first end. The apparatus and method of use are especially useful during the training of soccer players but may be utilized with plethora of other sports. Unlike prior art ball throwing devices, the present art apparatus and method of use is capable of imparting user desirable, repeatable, and adjustable velocities, elevations, trajectories, angular velocities or yaws, and spins to a ball.

For the present art, the throwing arm is pivotally attached with a throwing arm support which is attached with said base. One or more energy storage elements are connected between a second end of the throwing arm and an accelerator. The pivotal connection of the throwing arm is between said first and second ends of the throwing arm. As described, the energy of the energy storage elements is fully depleted when the apparatus is utilized and the energy storage elements come to a resting non-displaced position. The accelerator adds additional energy to the ball when depressed, preferably by a user's foot. The accelerator has multiple adjustment positions which allow varied and controlled amounts of energy to be imparted to the ball.

Upon cocking the apparatus, a release or latch holds the throwing arm in a cocked position. The release or latch is connected with a release linkage which is operated by the user and allows a ball to be launched. For the preferred embodiment, a safety assembly is mounted near the release linkage and prevents unintended or accidental discharge.

Especially unique to the present apparatus is the adjustable ball mount. The ball mount has a mount support bracket which allows for yaw or windage trajectory adjustment and a ball retainer which allows for elevation or pitch trajectory adjustment. The combination of the two adjustments further allows the user to place a spin, curve, or non-linear trajectory upon the ball. For the preferred embodiment, the support bracket and ball retainer have a serrated or grooved pair of locking disks there between which lock the respective positions of the two in place when tightened by a fastener. This unique locking feature provides repeatable ball launching characteristics and trajectories.

The apparatus is substantially surrounded with guards which isolate the throwing arm space from the user space in order to promote user safety.

The art of the present invention may be manufactured from a variety of materials provided that said materials are able to withstand the stresses applied during operation of the apparatus. Said materials include but are not limited to various metals and their alloys, woods, rubbers, plastics, or composites.

BRIEF DESCRIPTION OF THE DRAWINGS

Numerous other objects, features and advantages of the invention should now become apparent upon a reading of the detailed description taken in conjunction with the accompanying drawings, in which.

DETAILED DESCRIPTION

Figure 1:
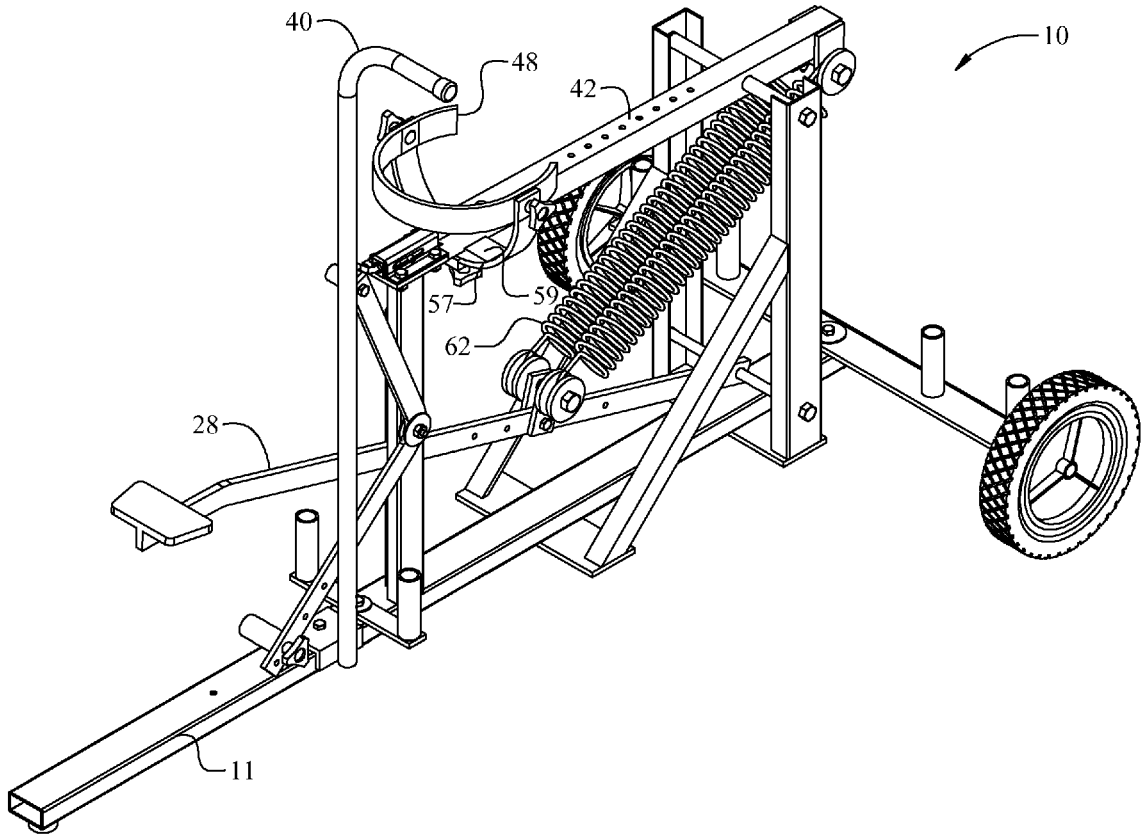
FIG. 1 is a left rear perspective view of an alternative embodiment ball projecting and training apparatus in a cocked or set position.
Figure 2:
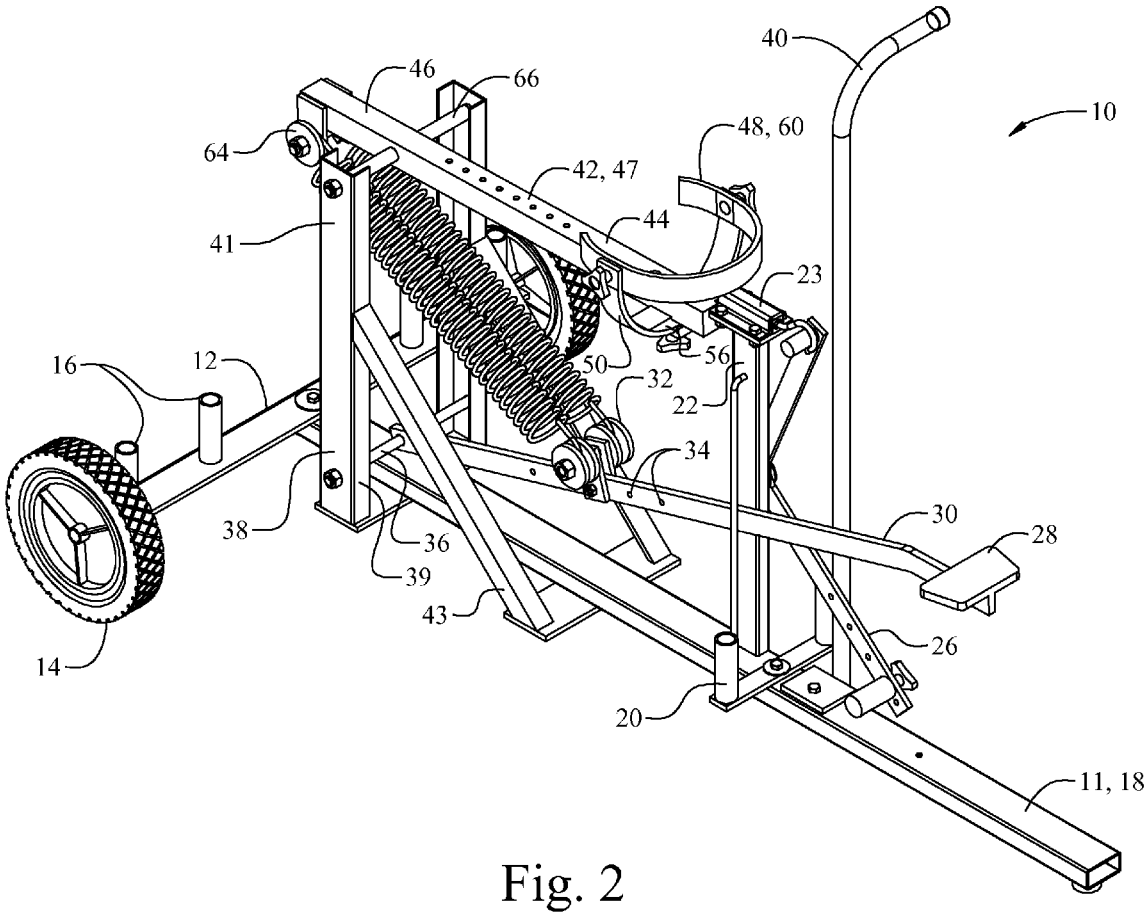
FIG. 2 is a right rear perspective view thereof.
Figure 3:
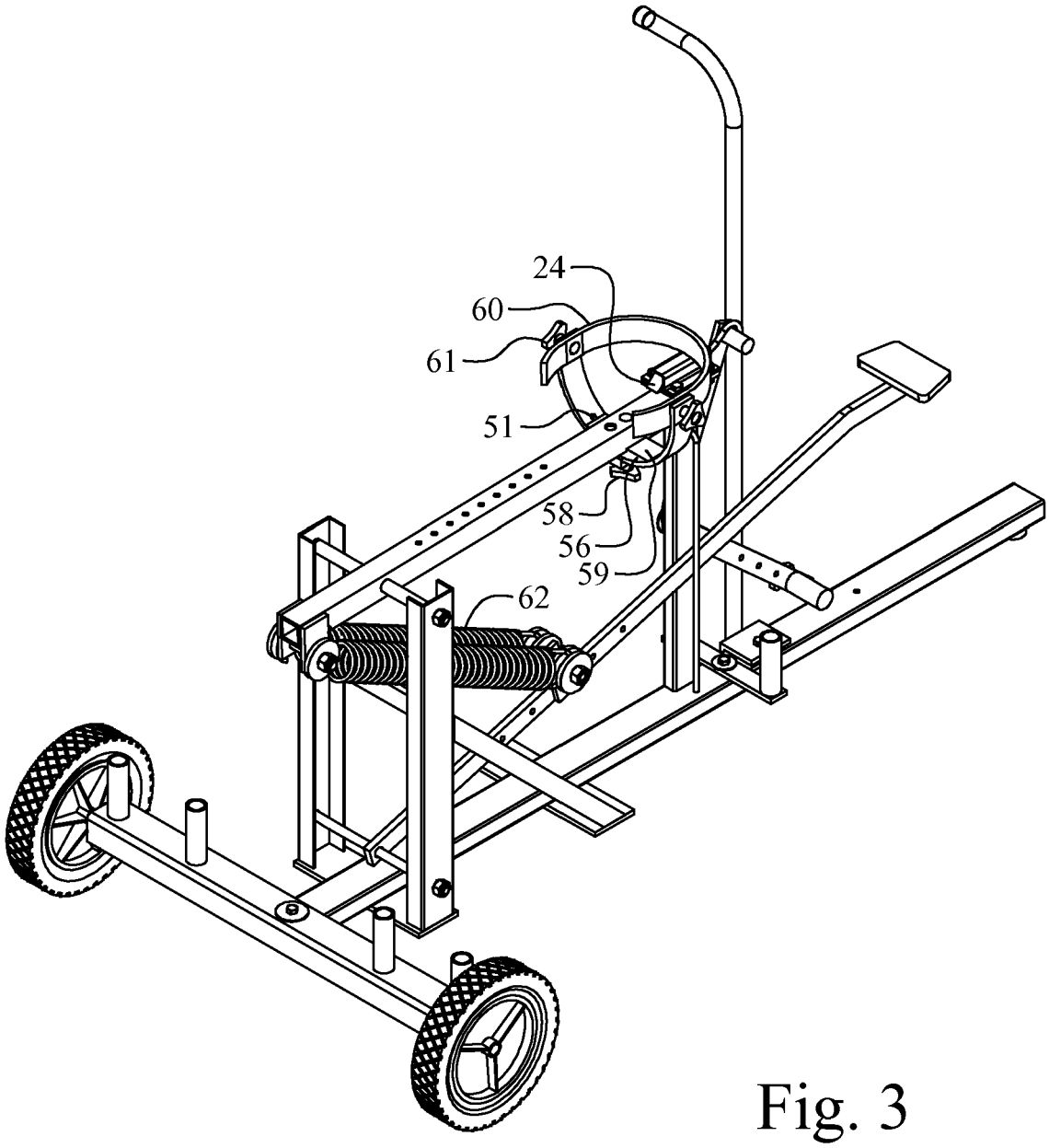
FIG. 3 is a right front perspective view thereof.
Figure 4:
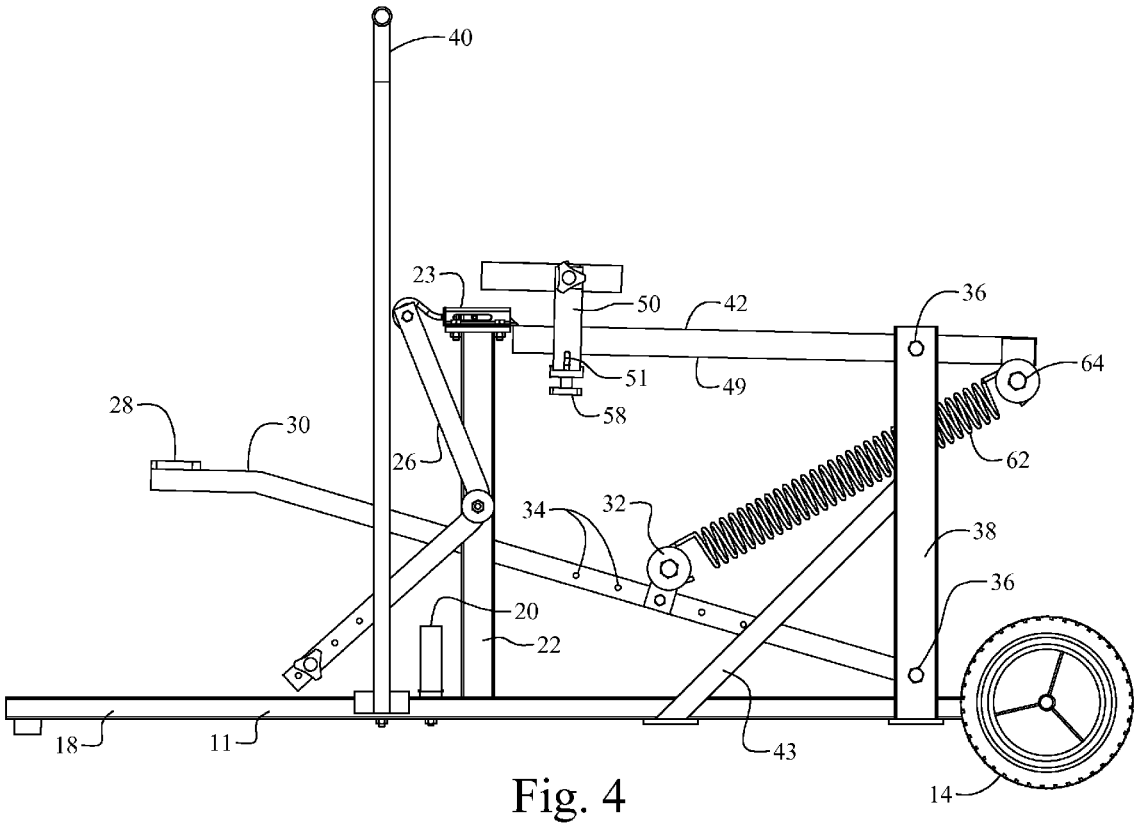
FIG. 4 is a left plan view thereof.
Figure 5:
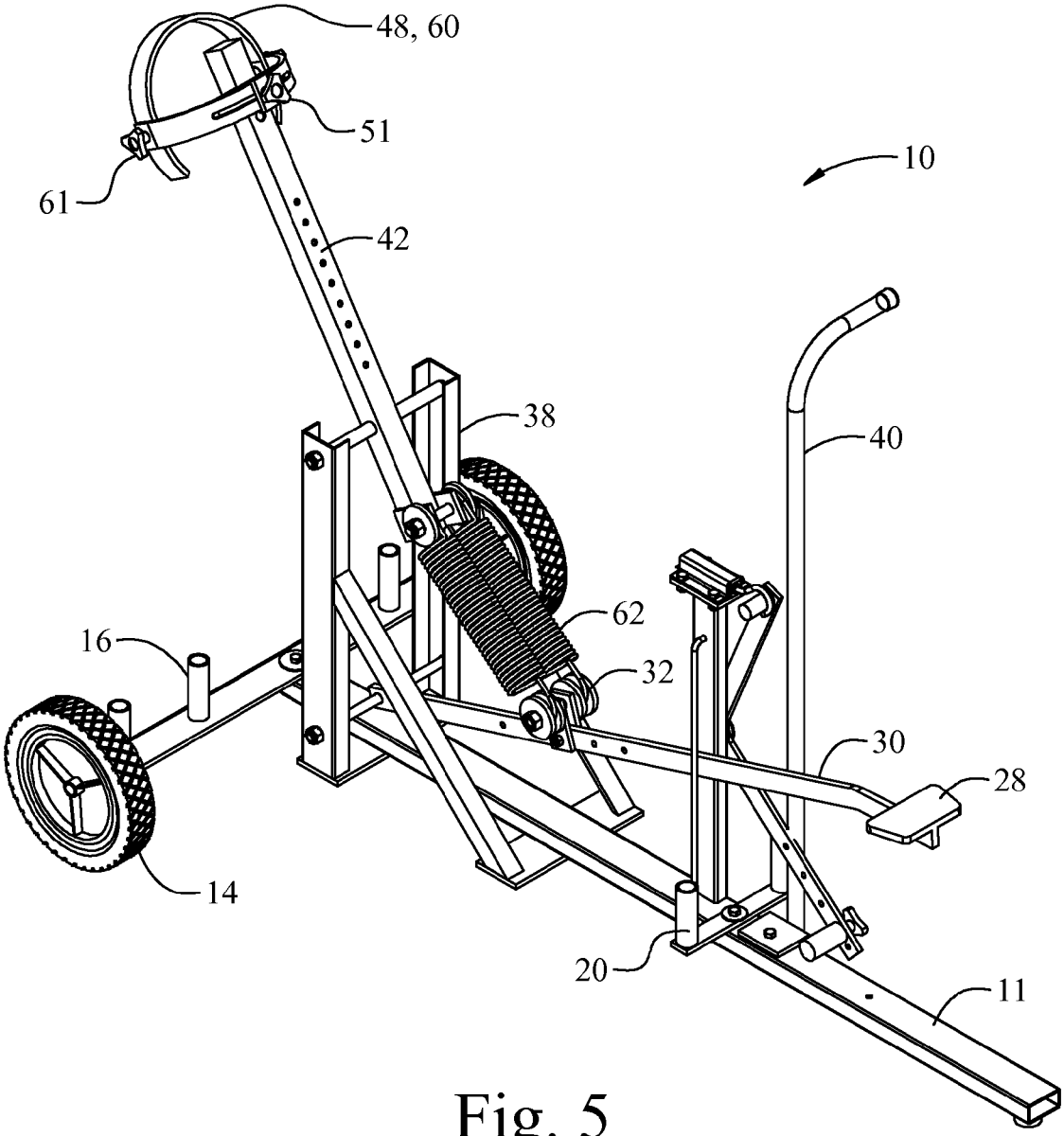
FIG. 5 is a left rear perspective view thereof in a released position.
Figure 6:
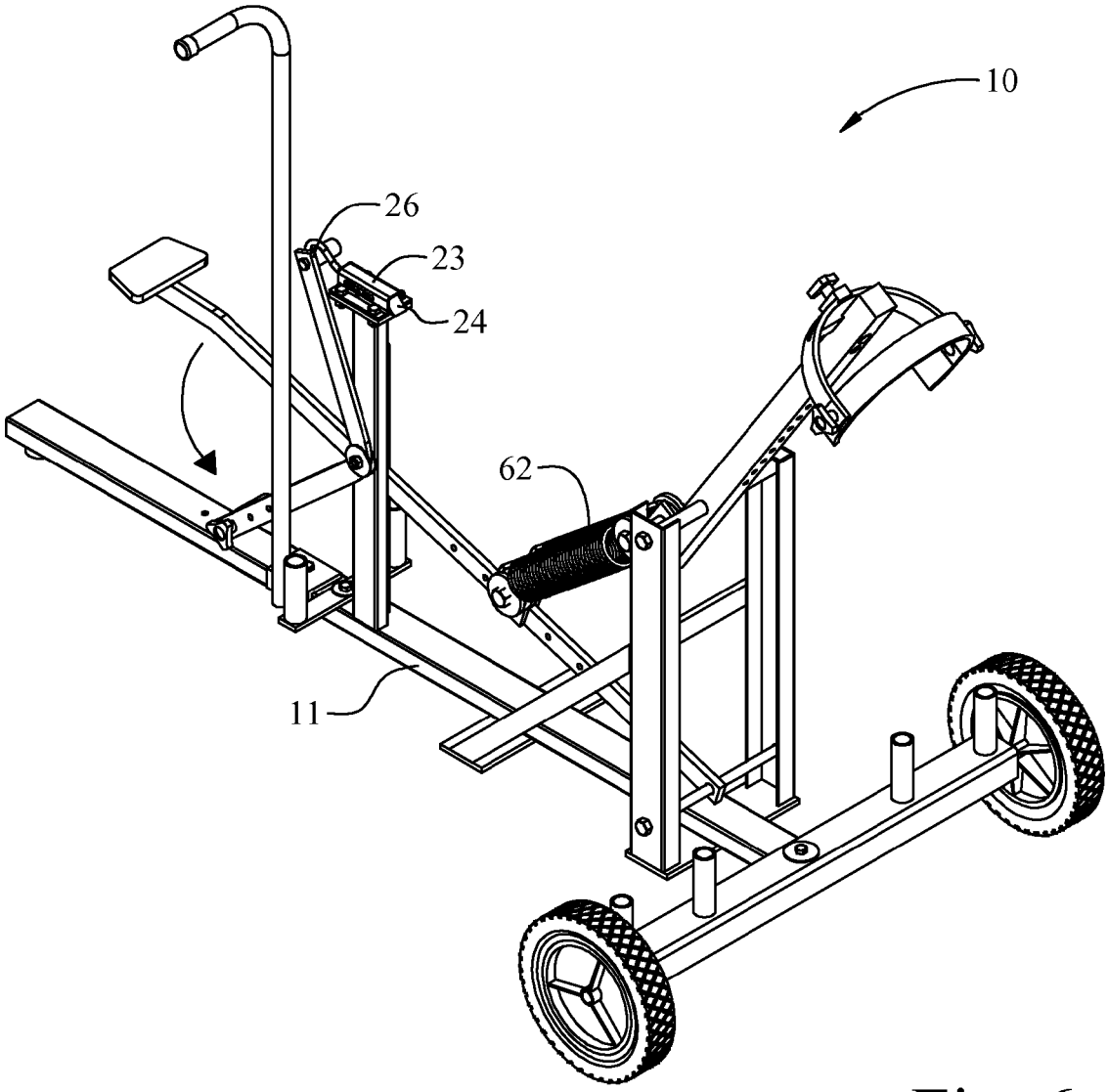
FIG. 6 is a front left perspective view thereof.
Figure 7:
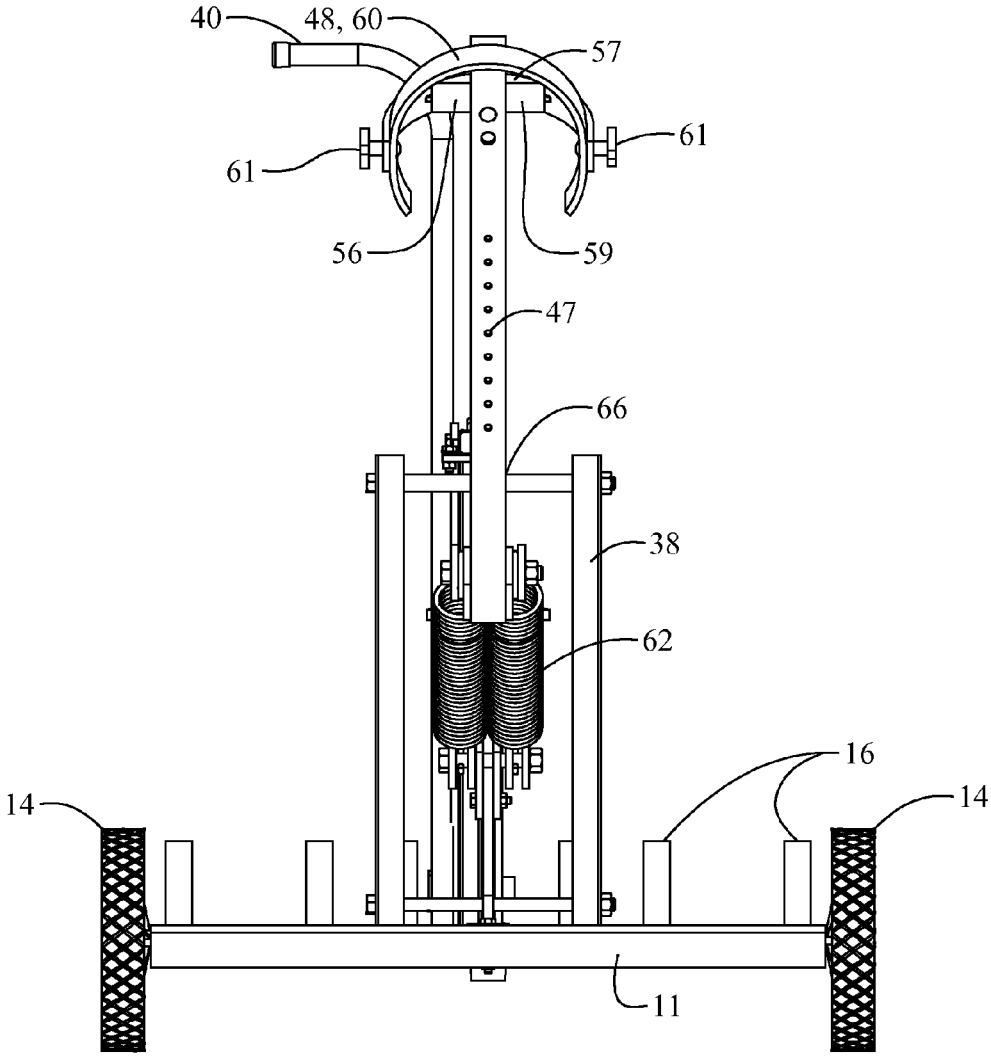
FIG. 7 is a front plan view thereof.
Figure 8:
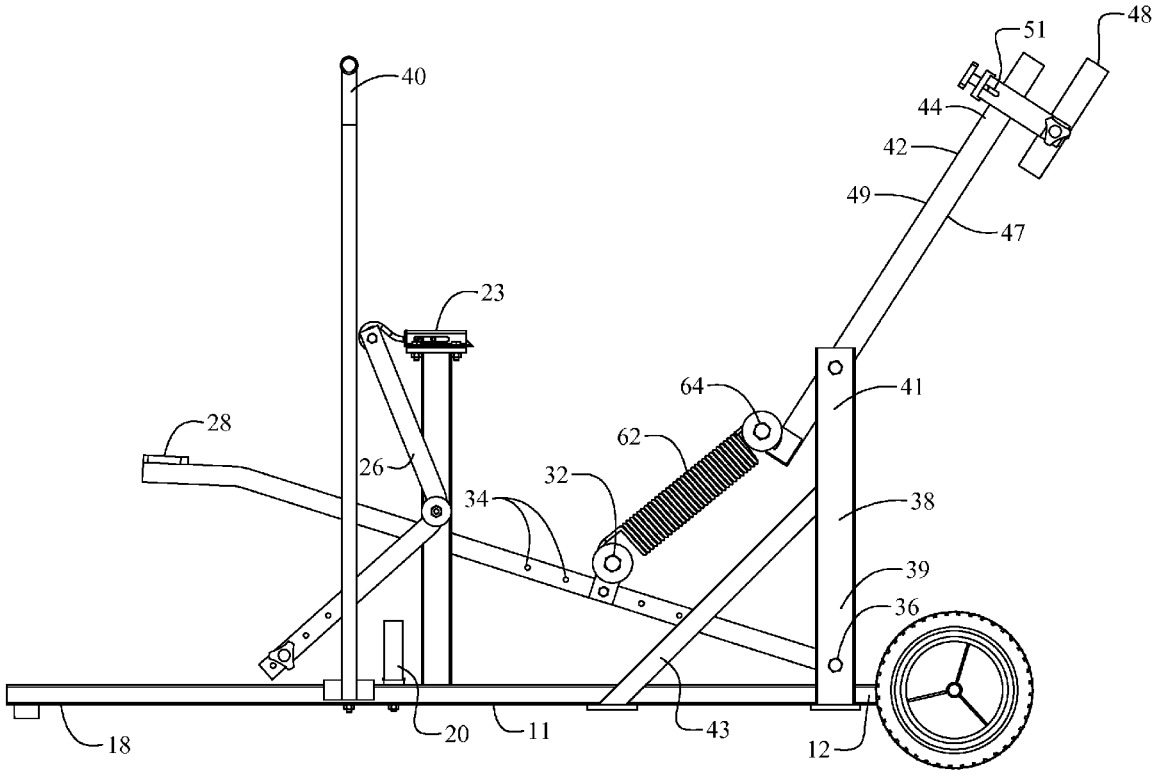
FIG. 8 is a left plan view thereof.
Figure 9:
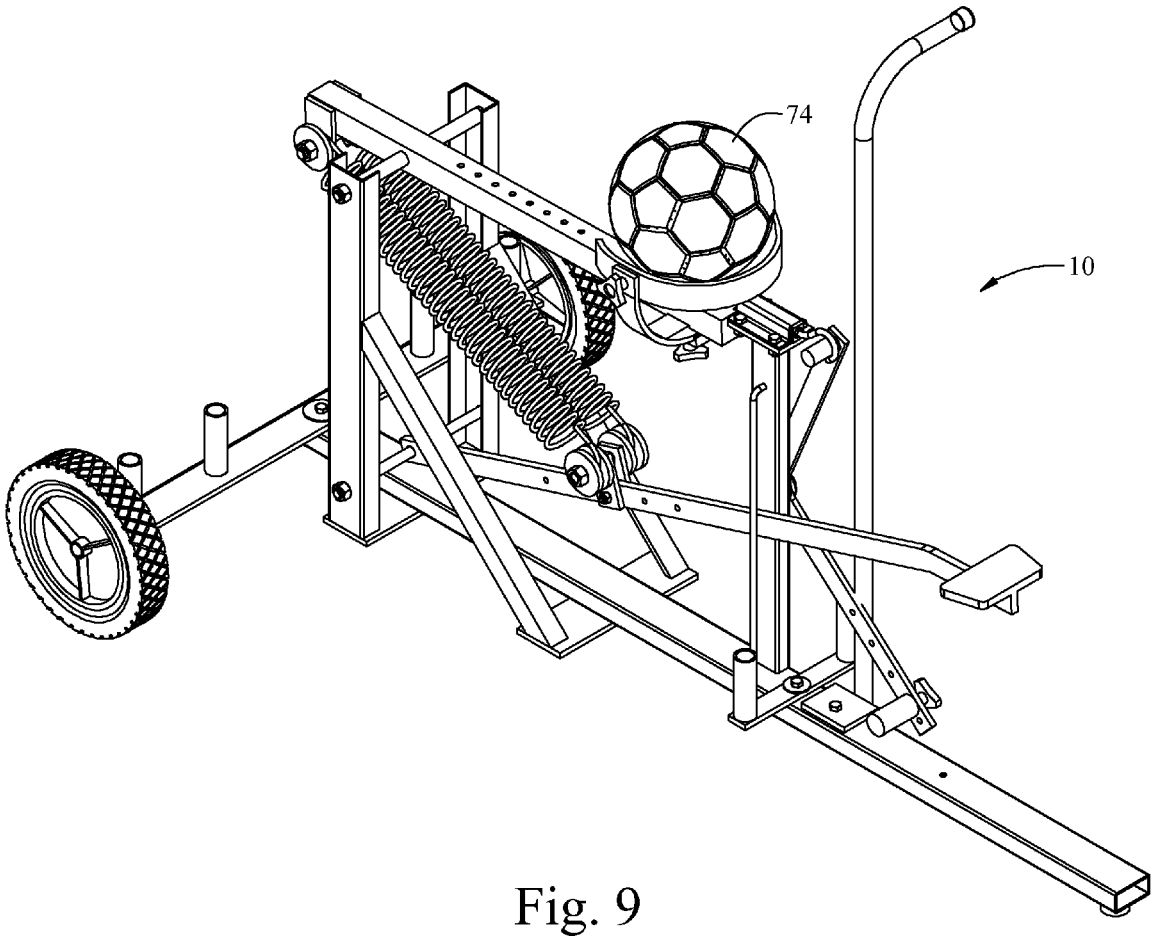
FIG. 9 is a left rear perspective view thereof in a cocked or set position with a ball placed therein and ready for projection.
Figure 10:
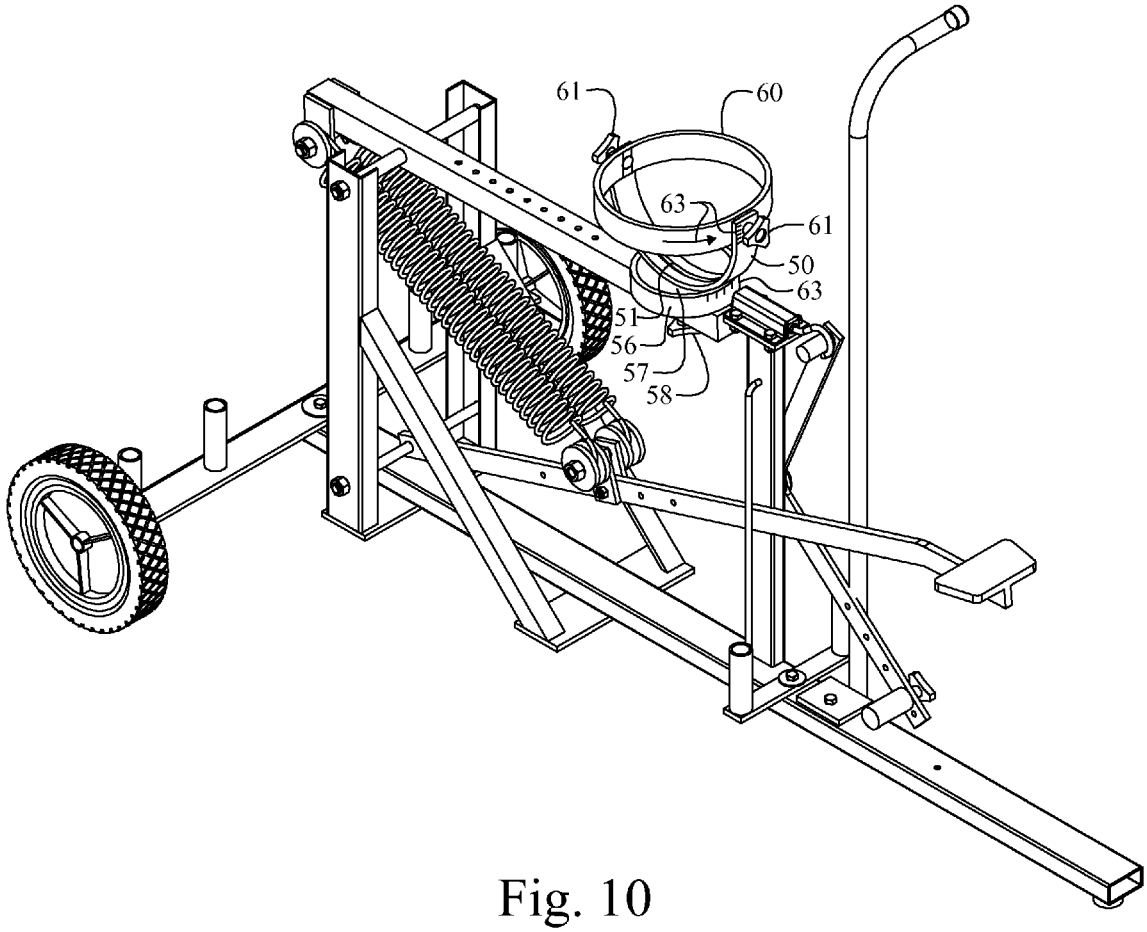
FIG. 10 is a right rear perspective view of an alternative embodiment ball projecting and training apparatus in a cocked or set position showing the alternative embodiment ball mount.
Figure 11:
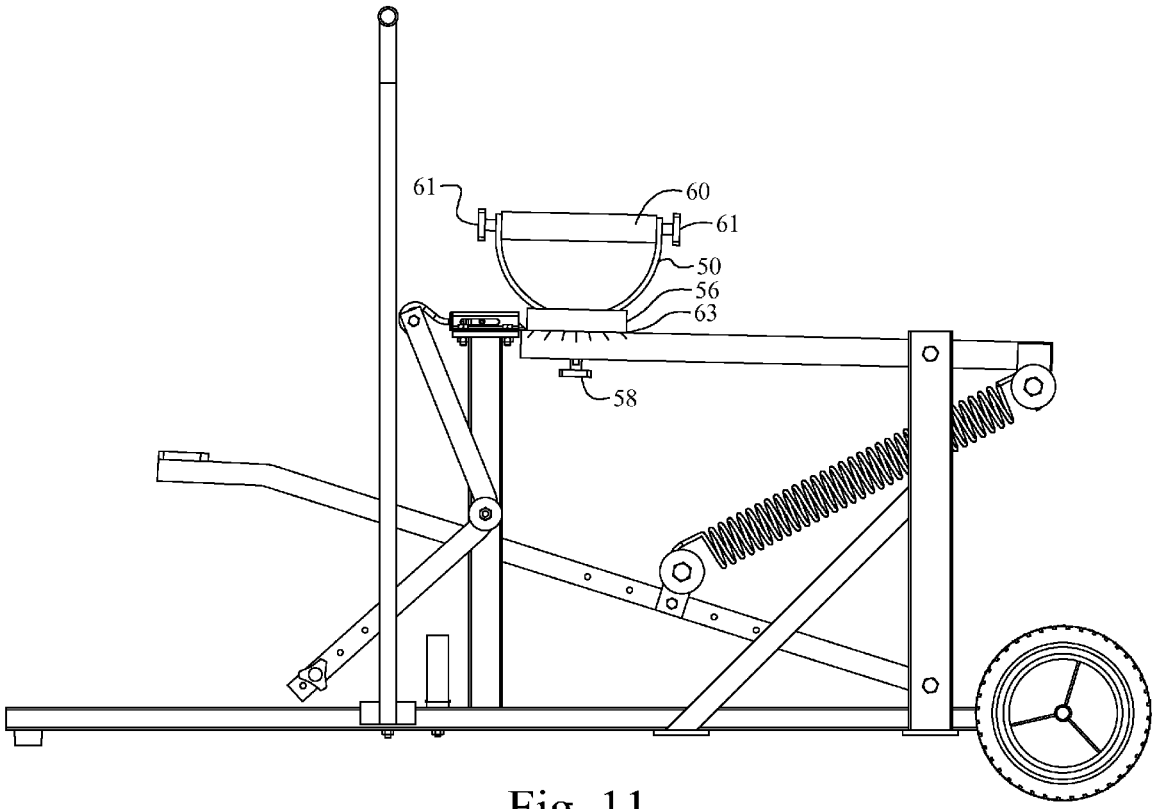
FIG. 11 is a left plan view thereof.
Figure 12:
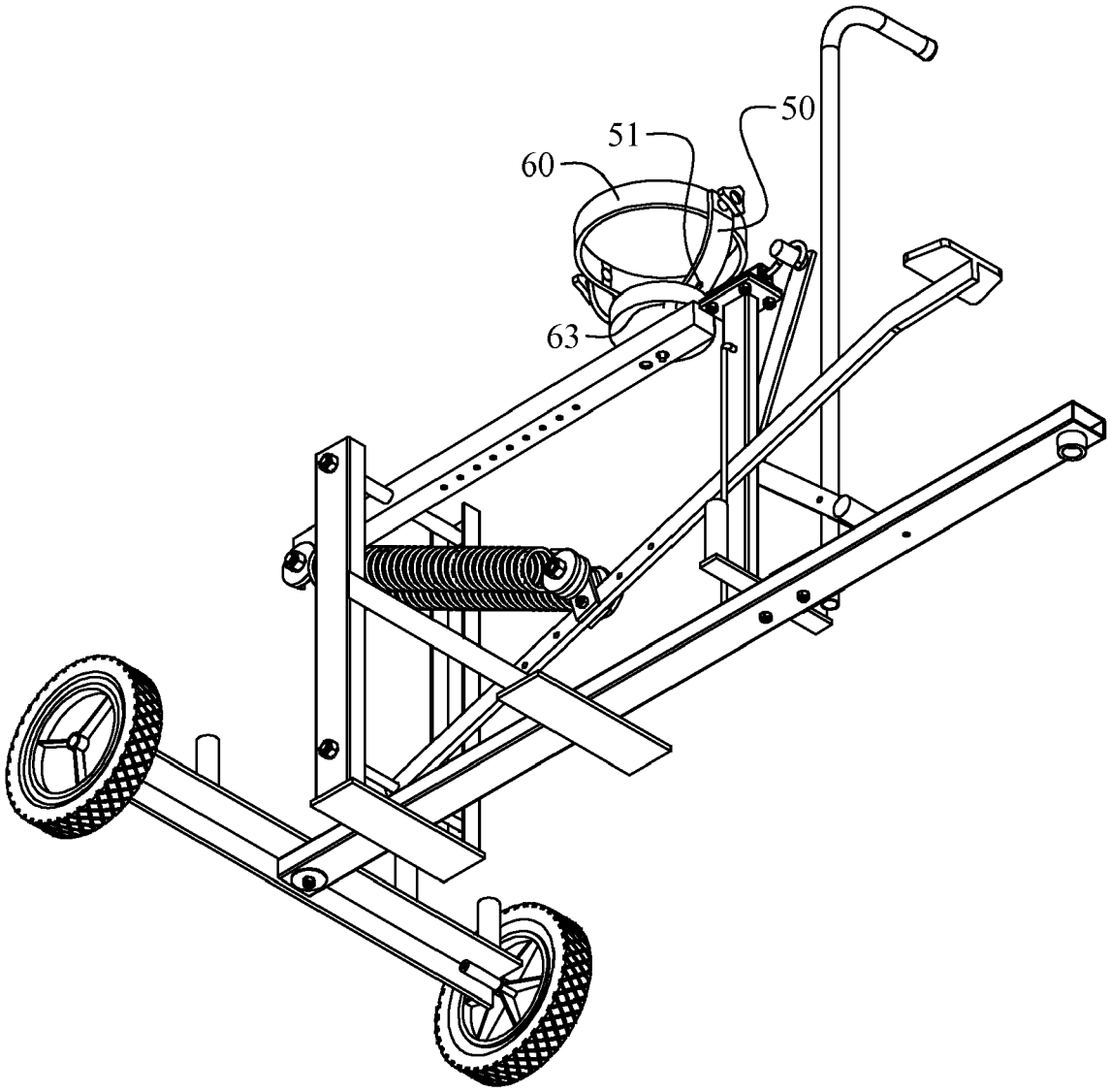
FIG. 12 is a bottom rear perspective view thereof.
Figure 13:
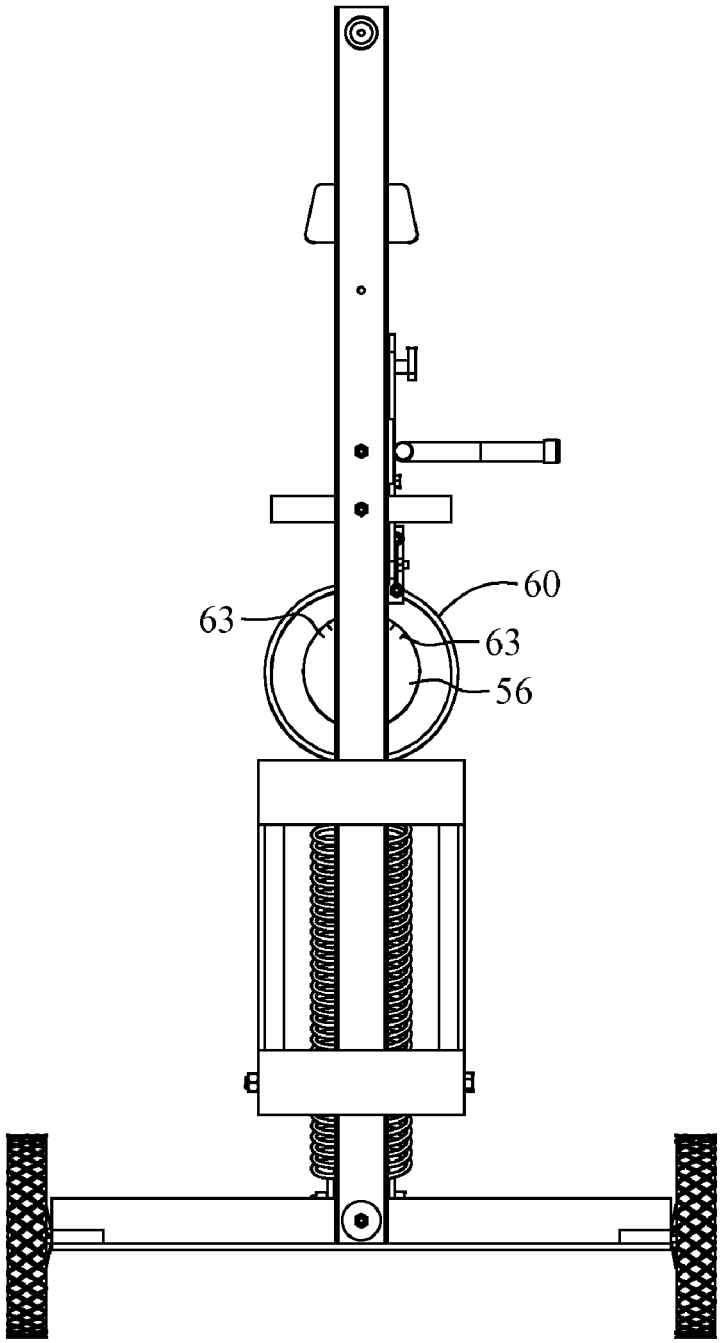
FIG. 13 is a bottom plan view thereof.
Figure 14:
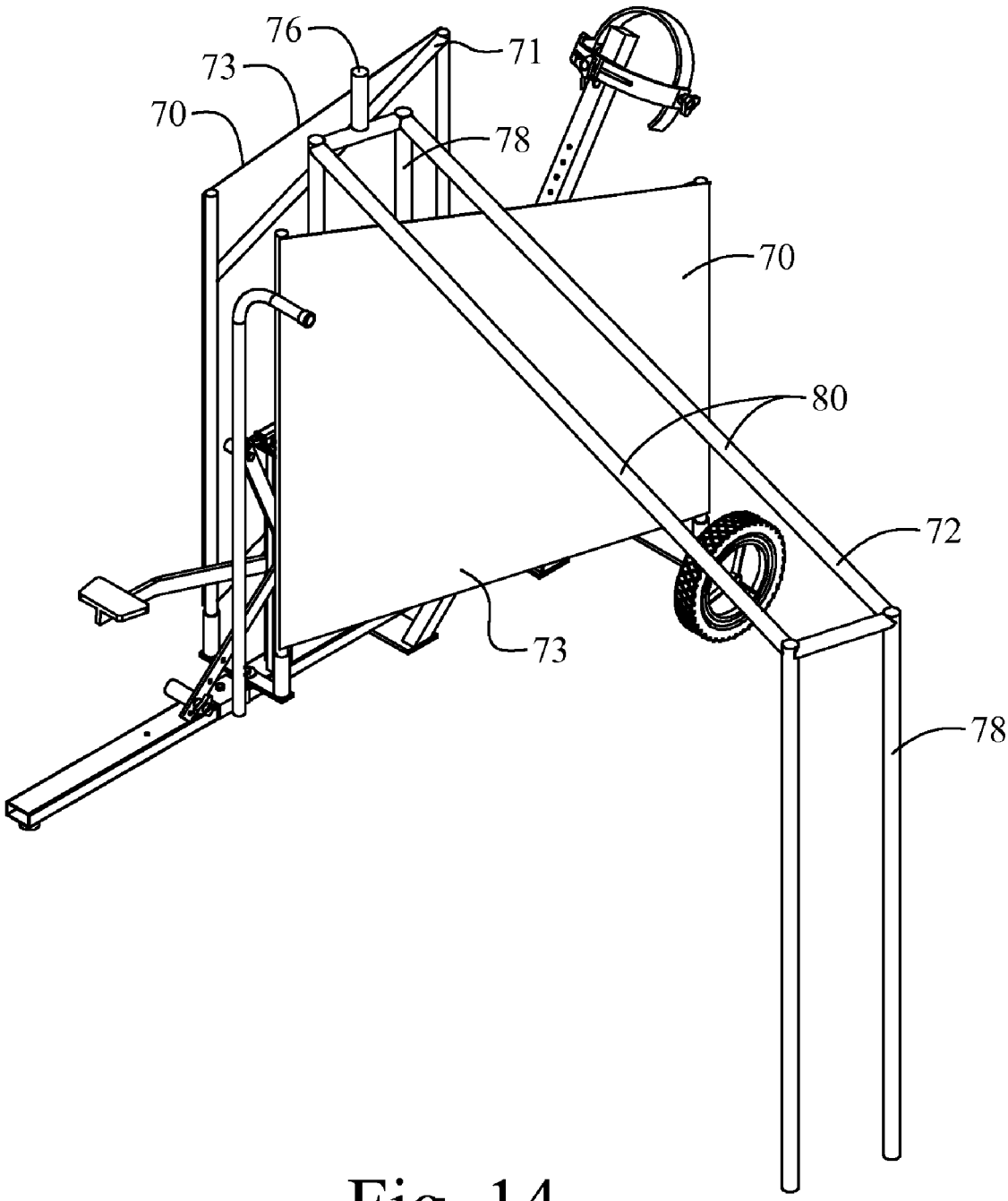
FIG. 14 is a left rear perspective view of an alternative embodiment ball projecting and training apparatus in a released position with guards and a ball storing and feeding structure installed.
Figure 15:
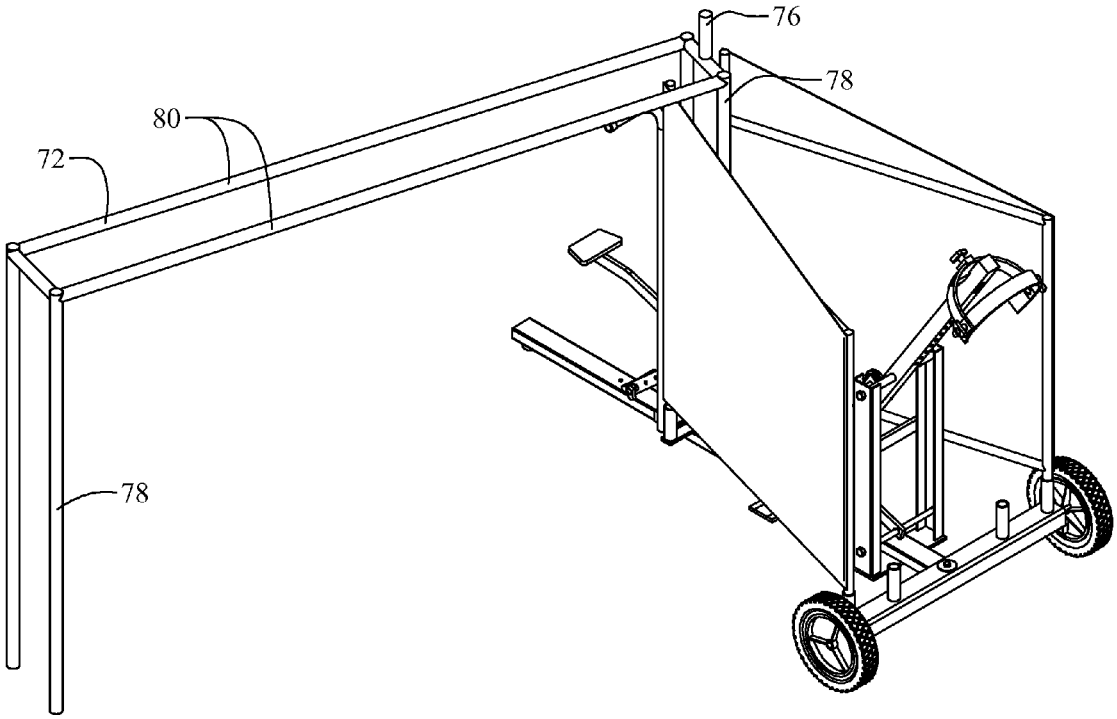
FIG. 15 is a left front perspective view thereof.
Figure 16:
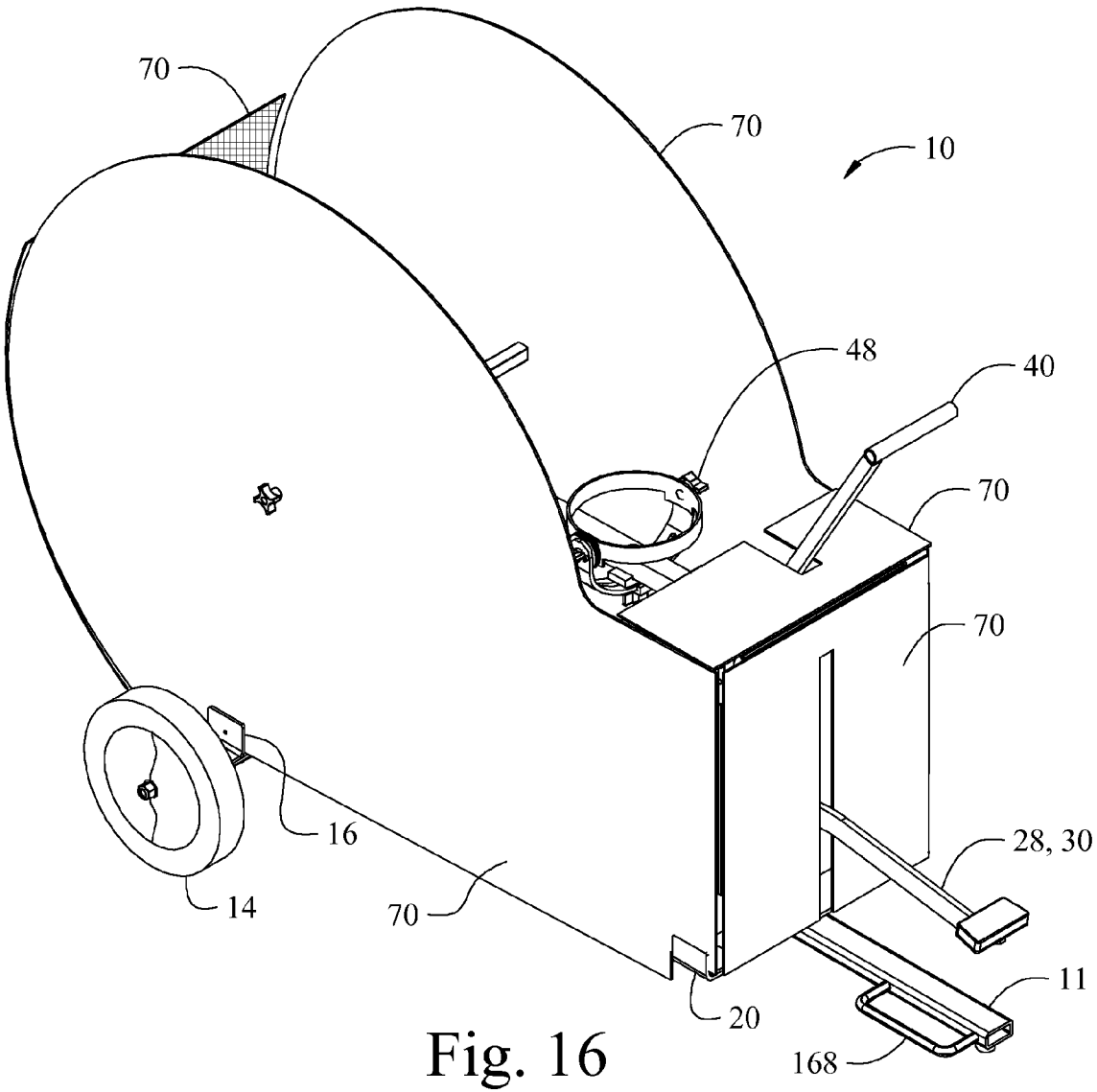
FIG. 16 is a right rear perspective view of a preferred embodiment ball projecting and training apparatus in a cocked or set position with guards in place.
Figure 17:
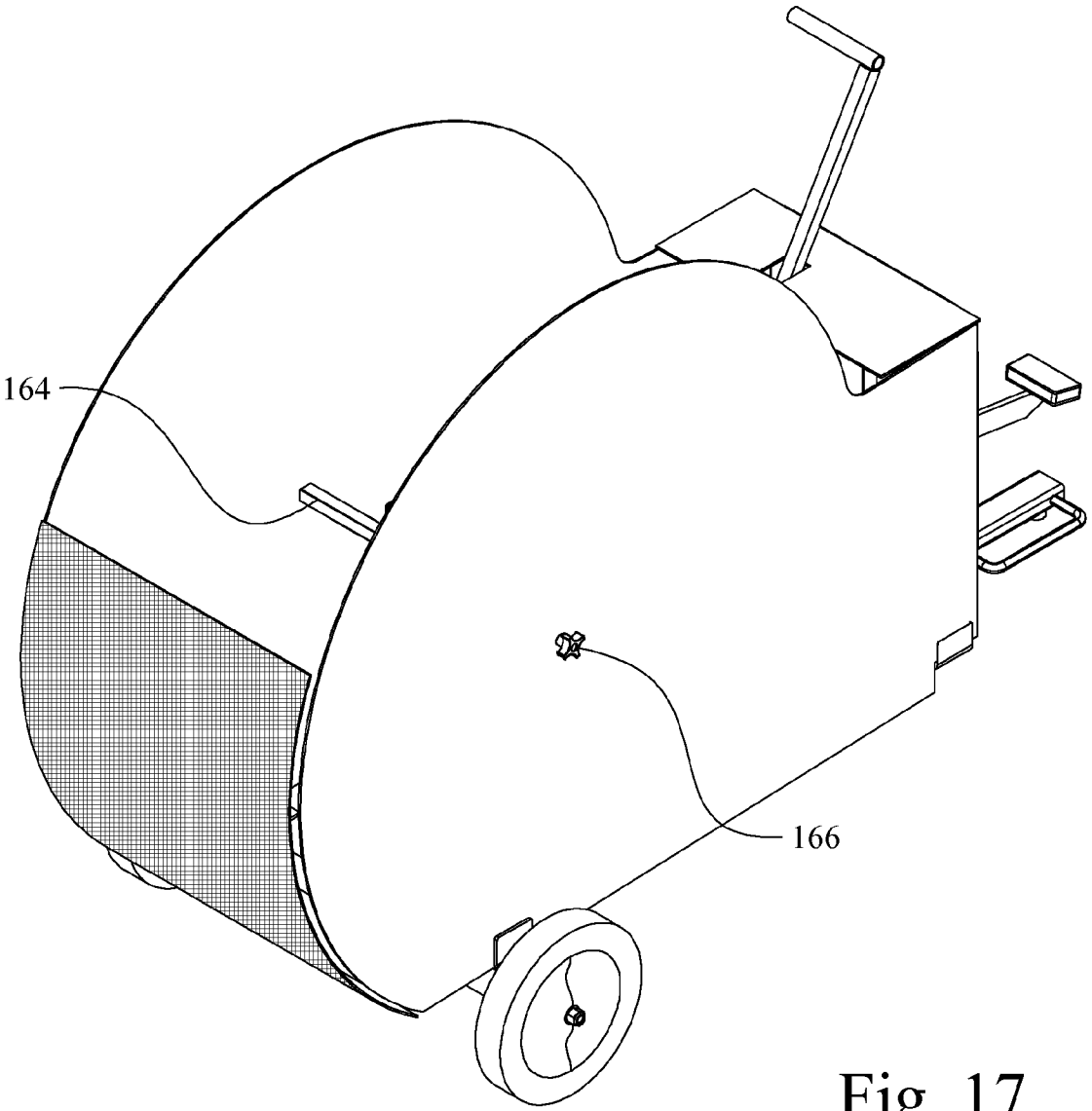
FIG. 17 is a right front perspective view thereof.
Figure 18:
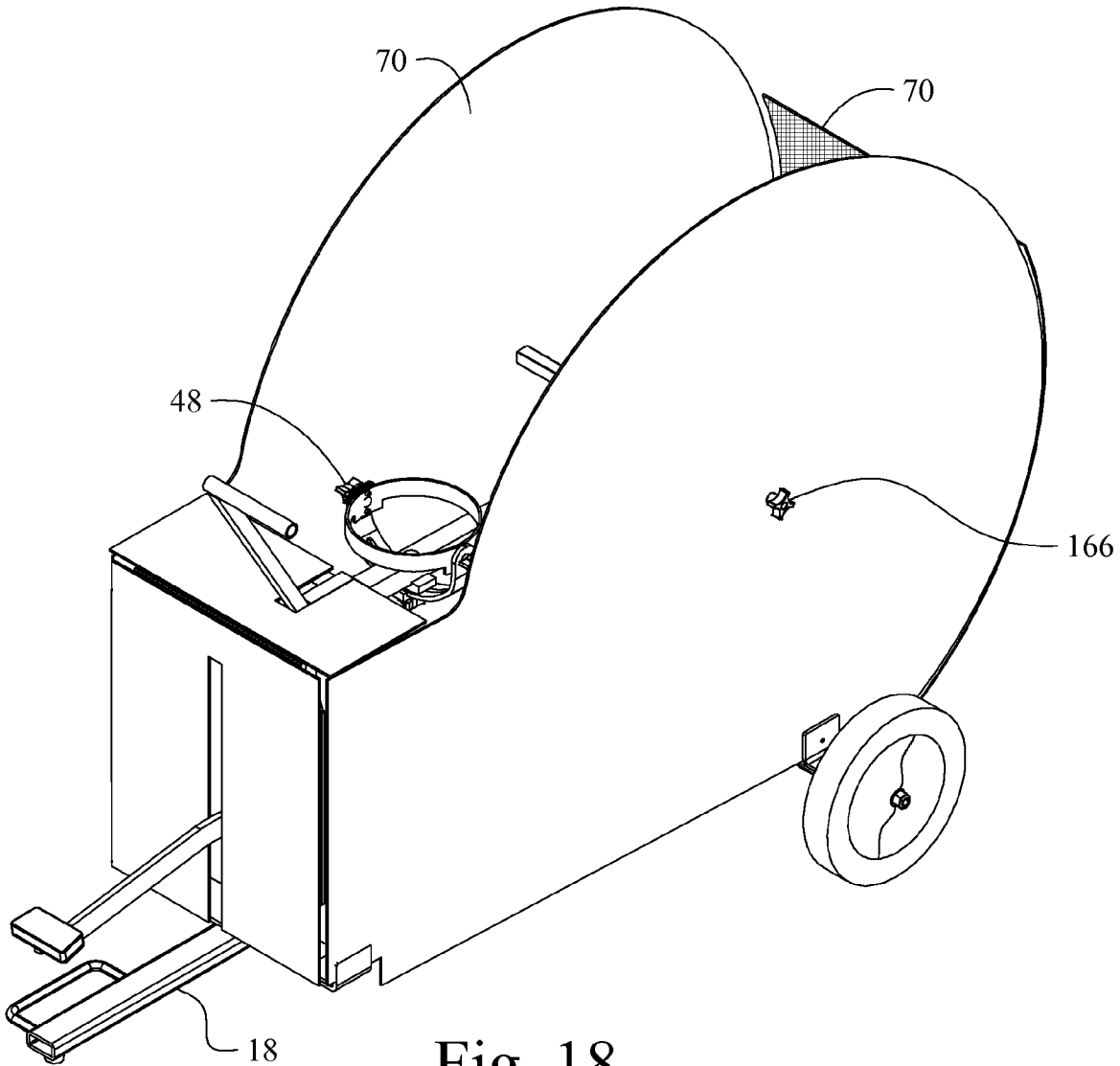
FIG. 18 is a left rear perspective view thereof.
Figure 19:
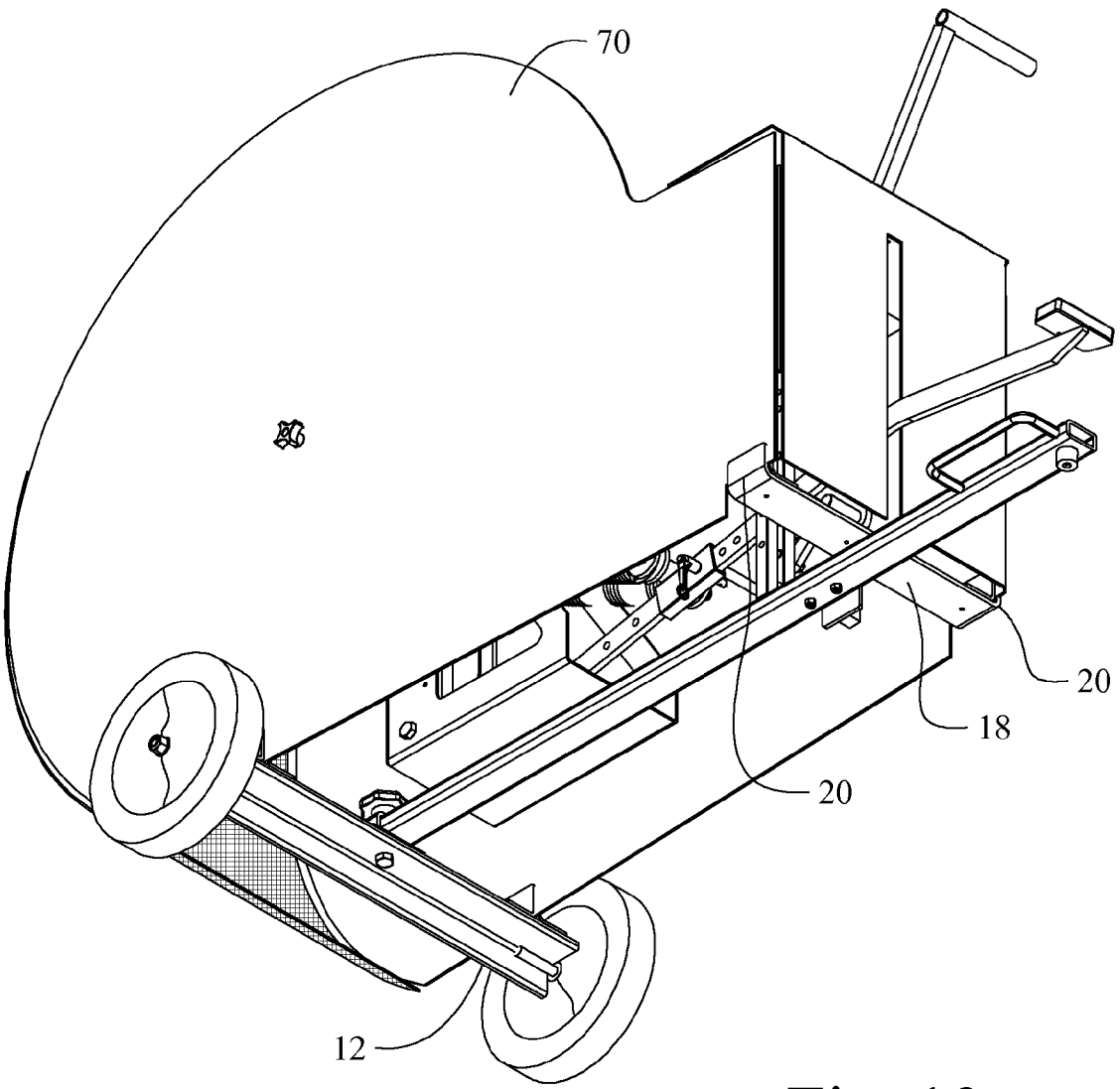
FIG. 19 is a left bottom perspective view thereof.
Figure 20:
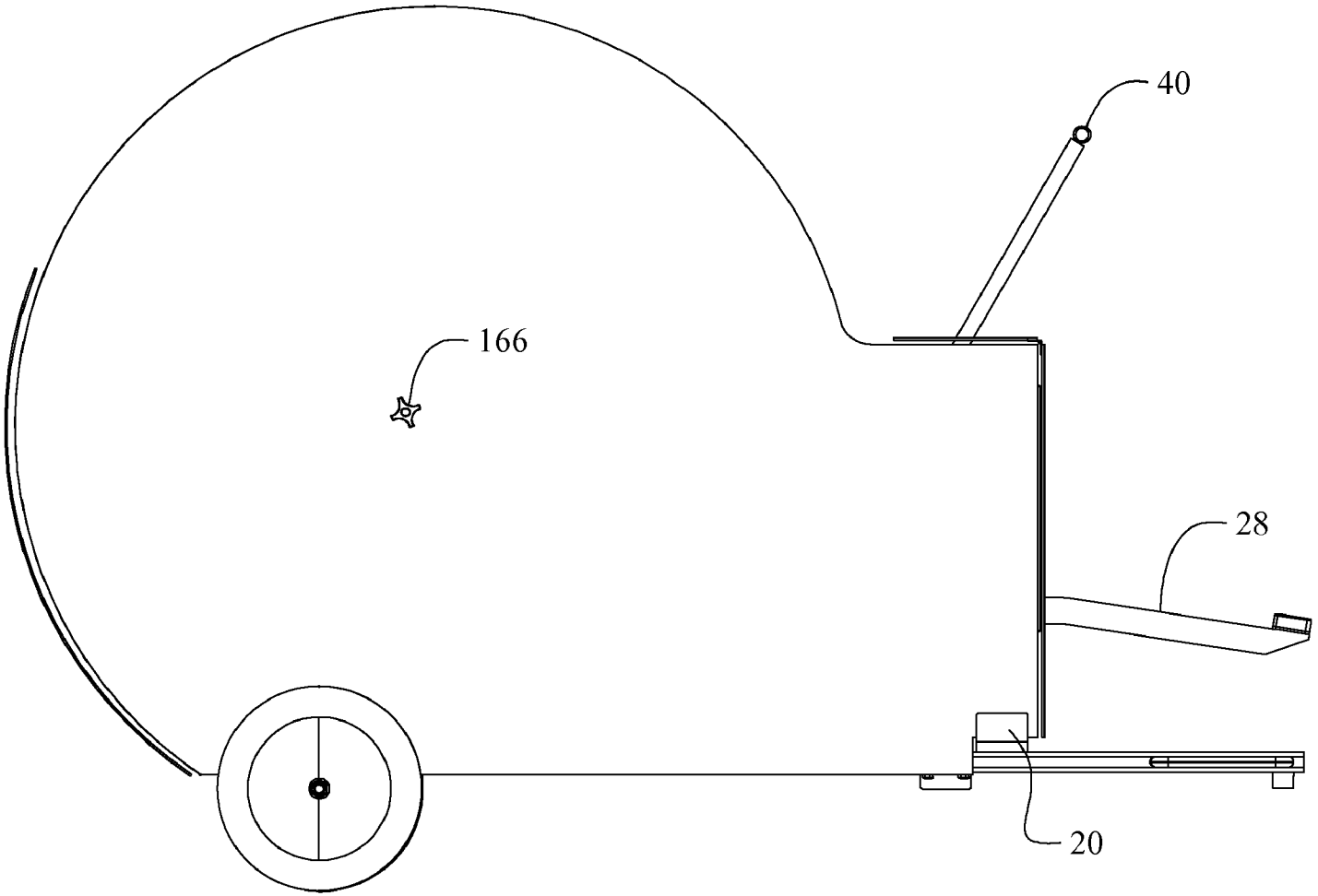
FIG. 20 is a right plan view thereof which is substantially a mirror image of a left plan view.
Figure 21:
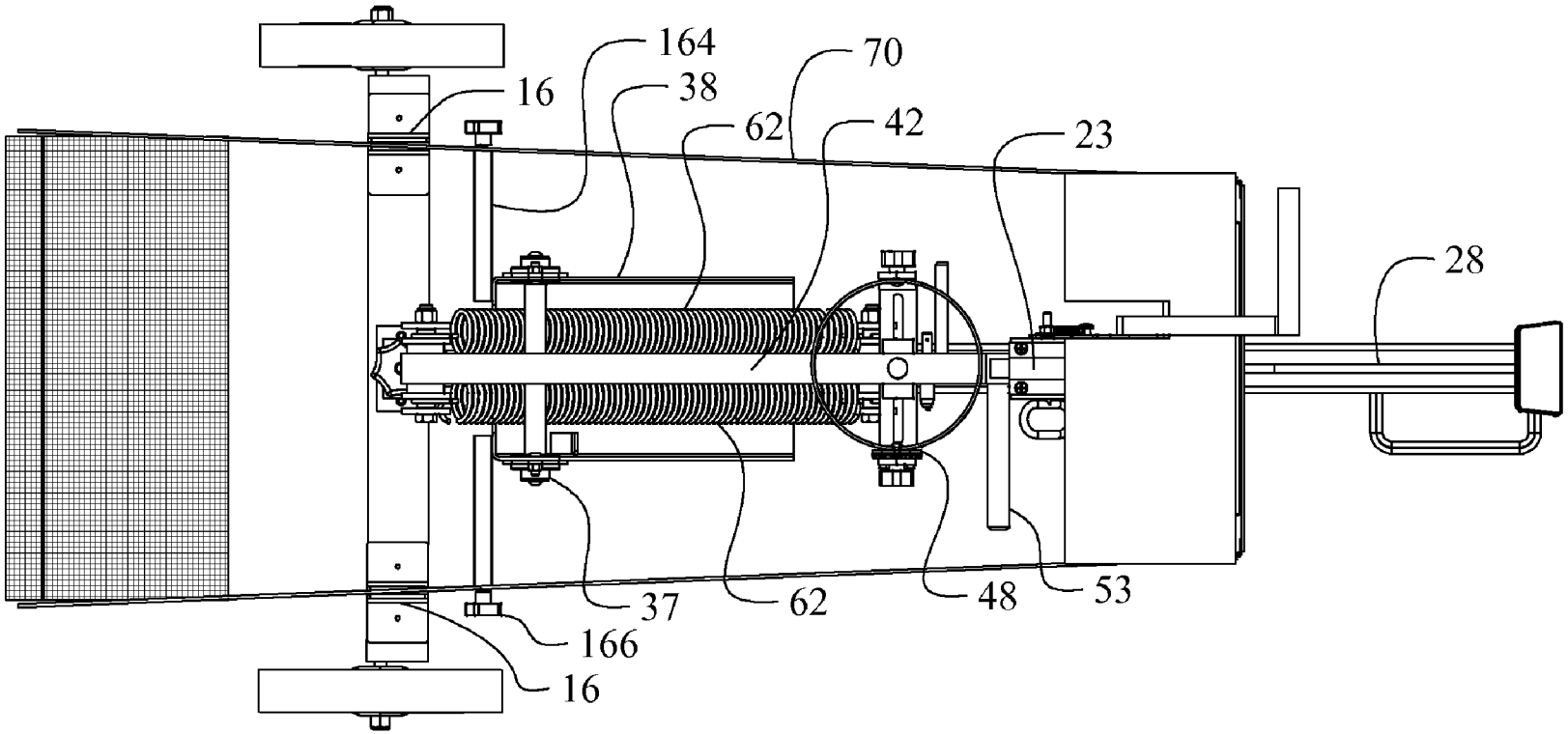
FIG. 21 is a top plan view thereof.
Figure 22:
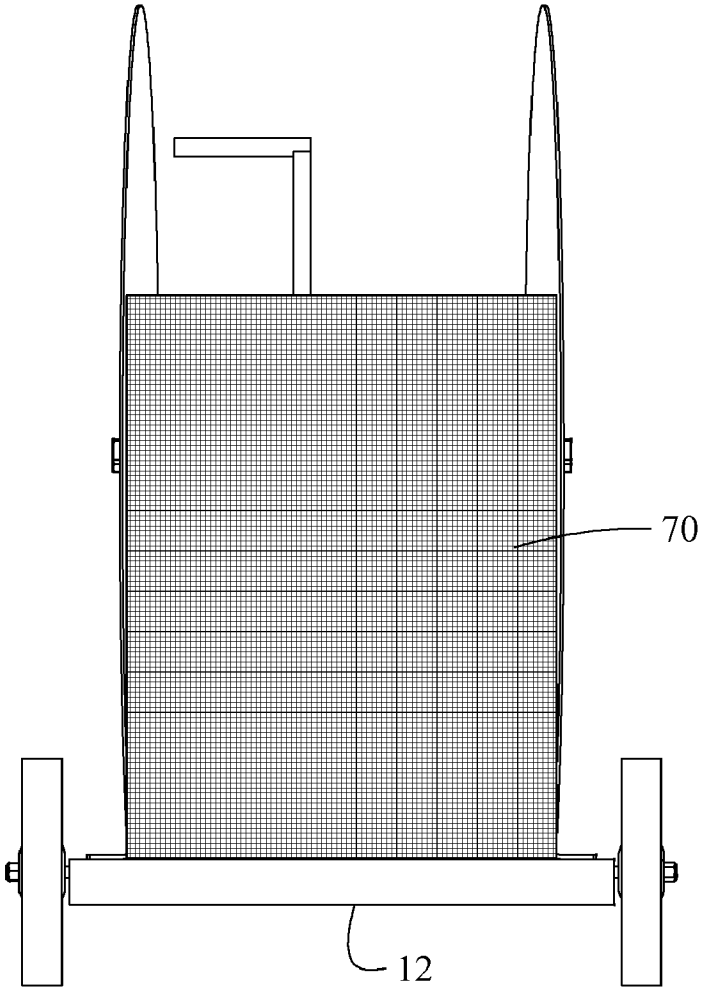
FIG. 22 is a front plan view thereof.
Figure 23:
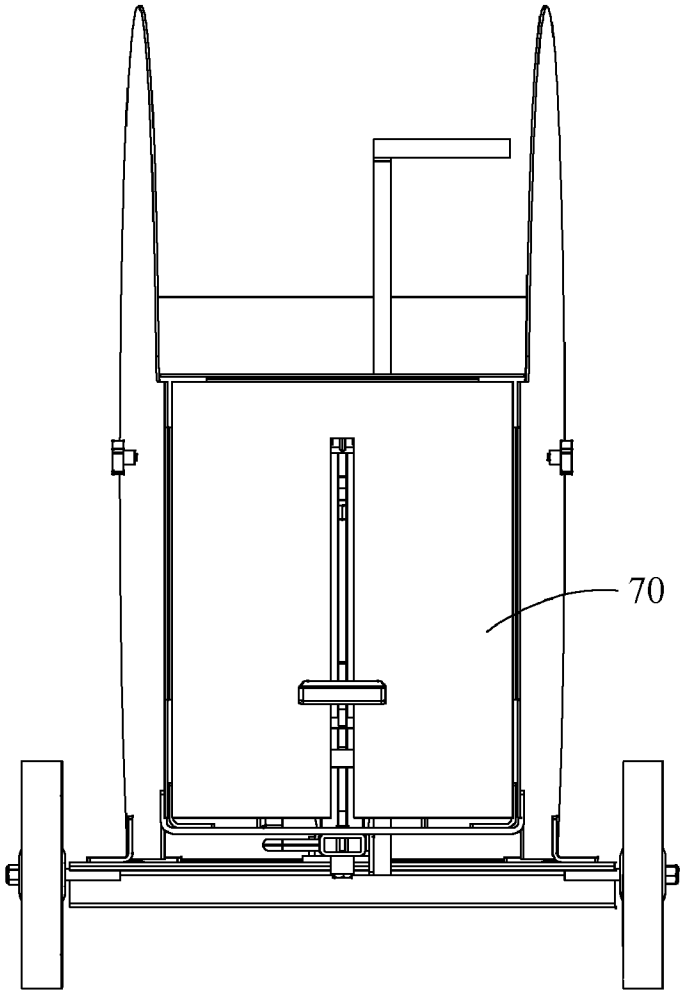
FIG. 23 is a rear plan view thereof.
Figure 24:
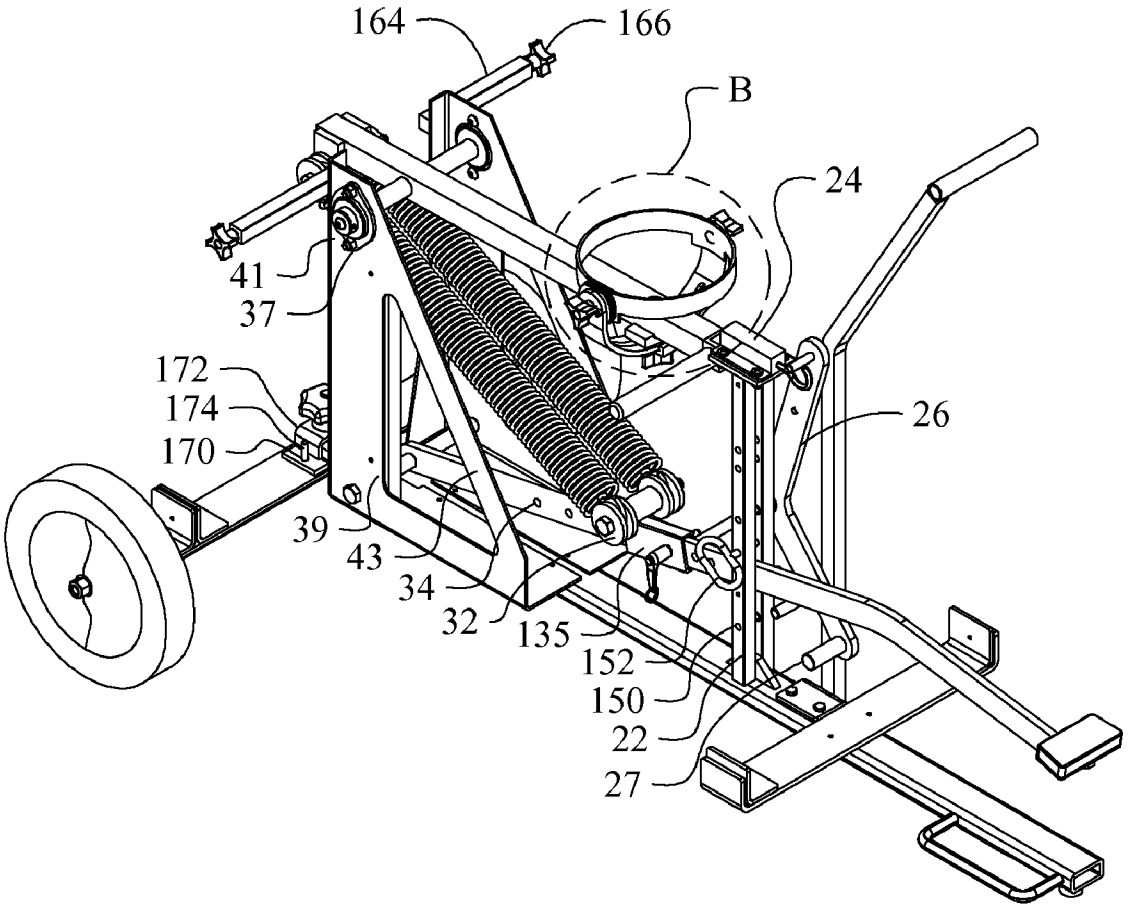
FIG. 24 is a right rear perspective view of a preferred embodiment ball projecting and training apparatus in a cocked or set position without the guard in place.
Figure 25:
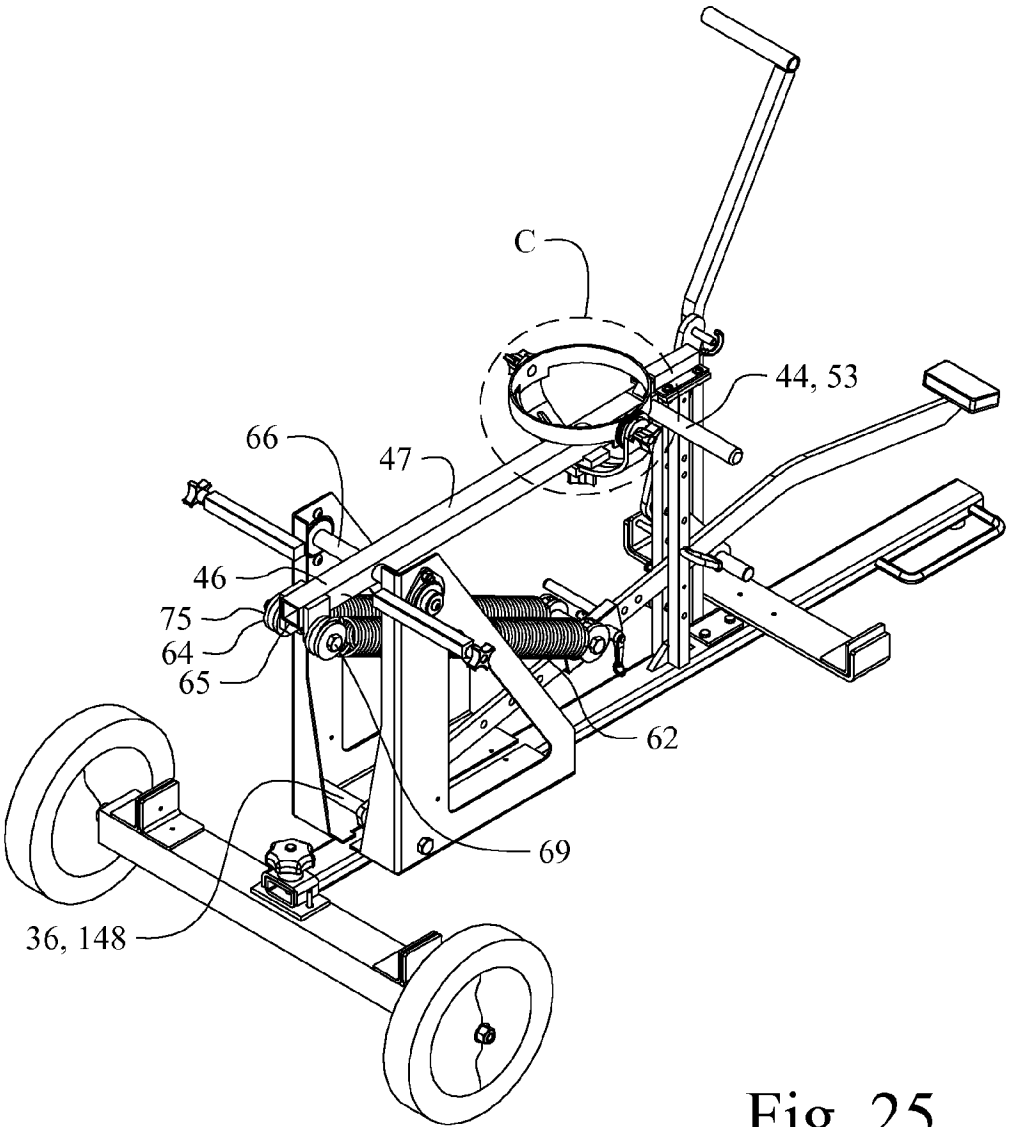
FIG. 25 is a right front perspective view thereof.
Figure 26:
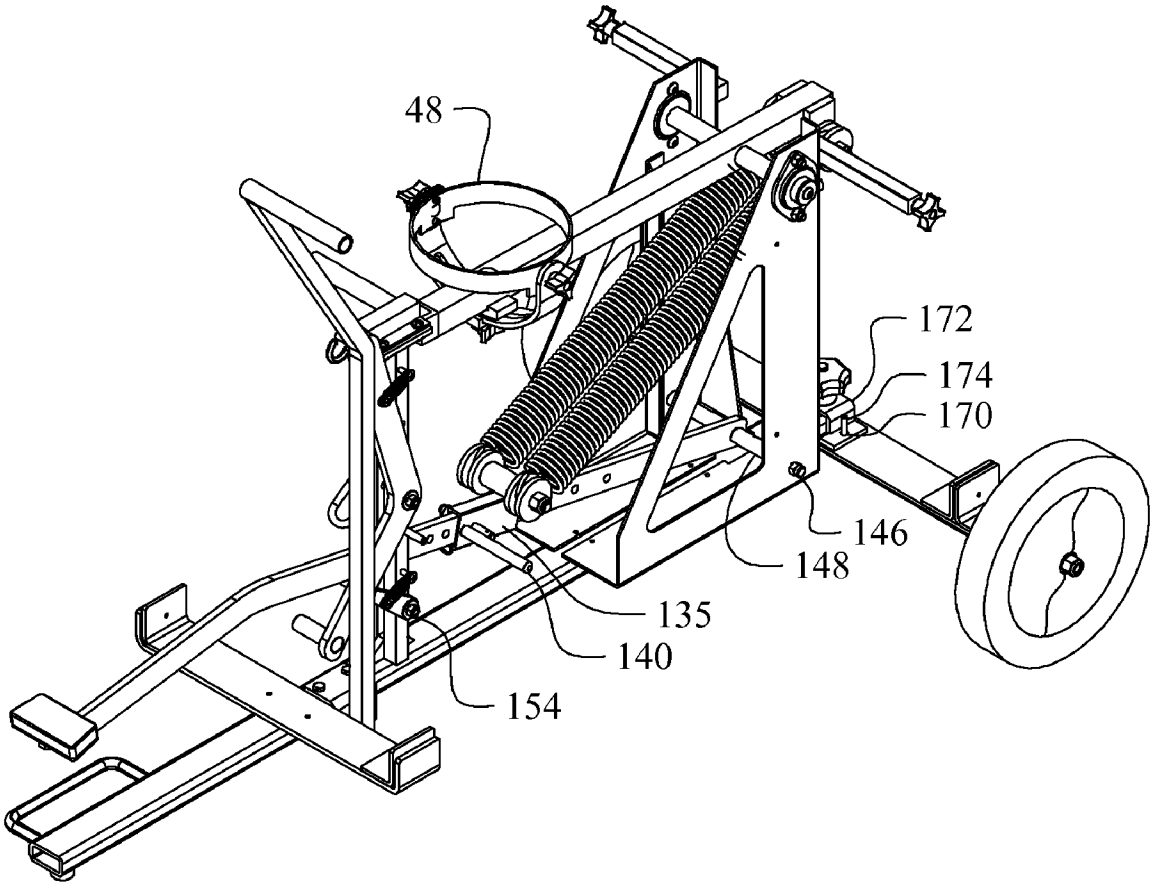
FIG. 26 is a left rear perspective view thereof.
Figure 27:
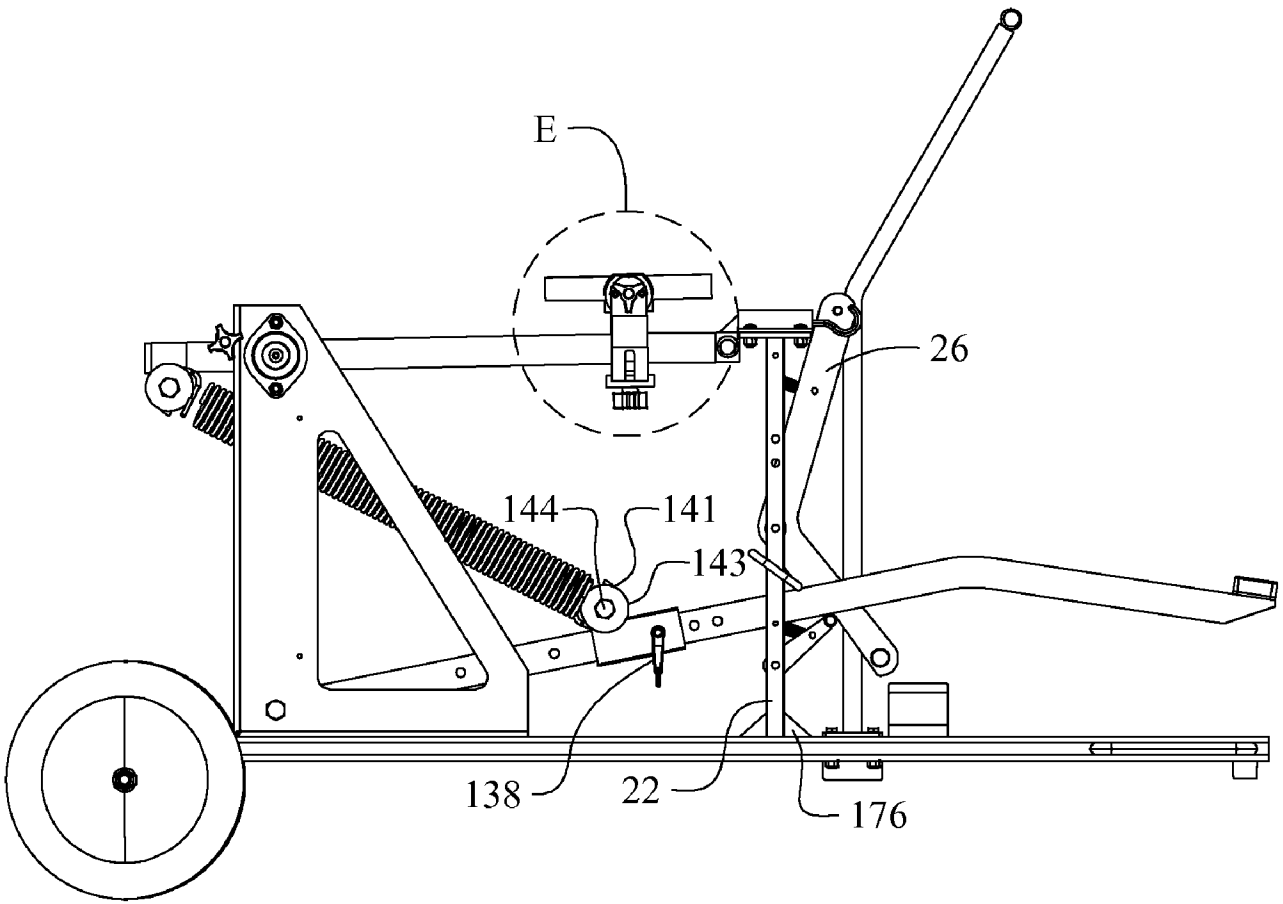
FIG. 27 is a right plan view thereof.
Figure 28:
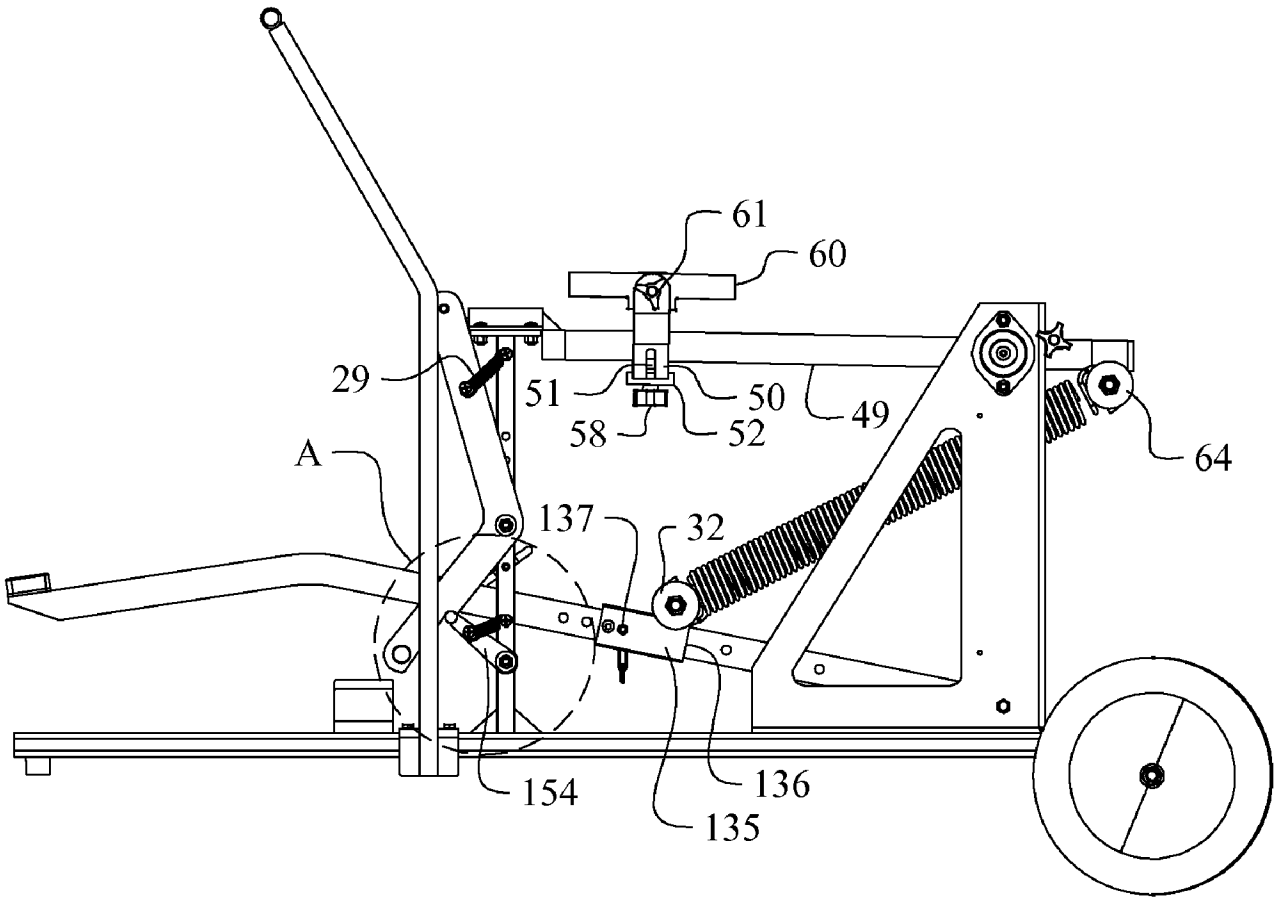
FIG. 28 is a left plan view thereof.
Figure 29:
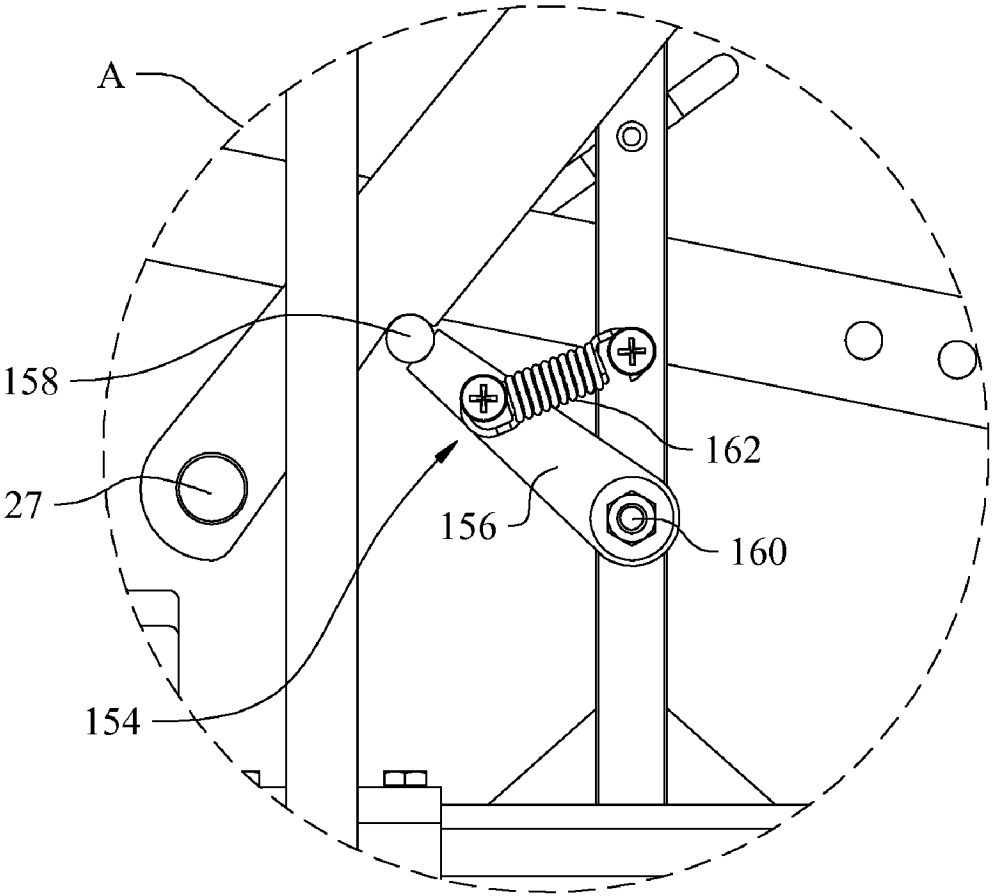
FIG. 29 is an enlarged fragmentary view as taken along section A of FIG. 28.
Figure 30:
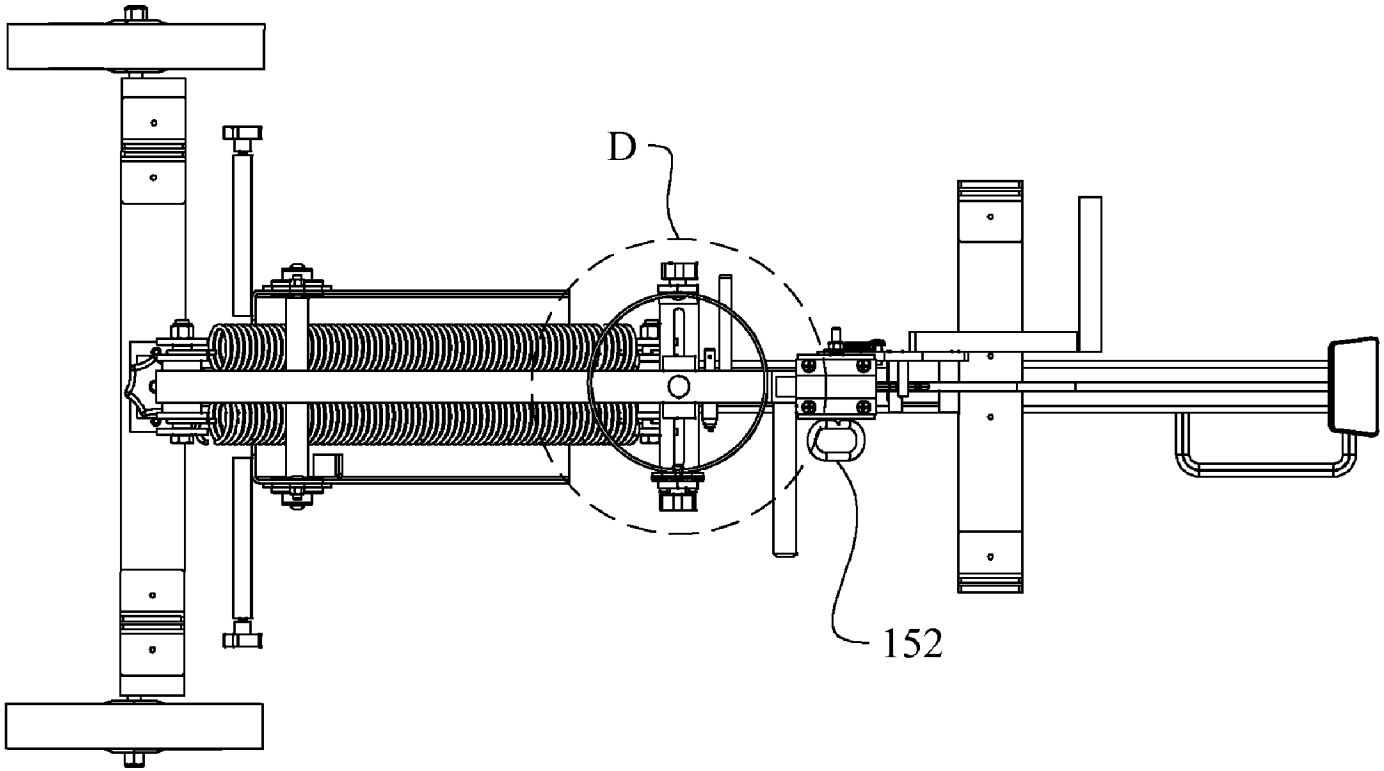
FIG. 30 is a top plan view of a preferred embodiment ball projecting and training apparatus in a cocked or set position without the guard in place.
Figure 31:
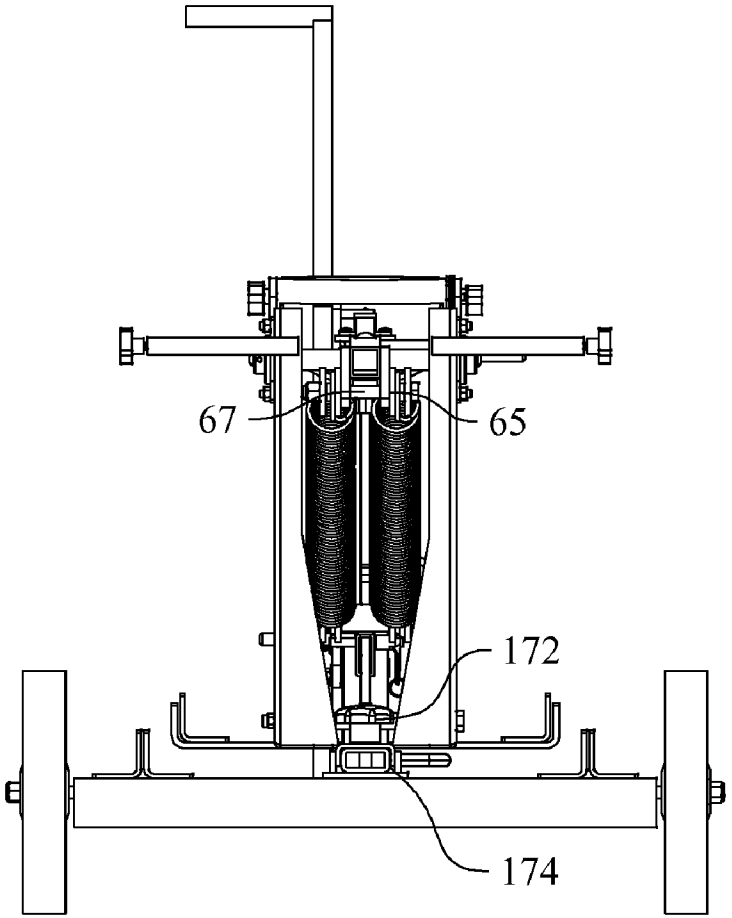
FIG. 31 is a front plan view thereof.
Figure 32:
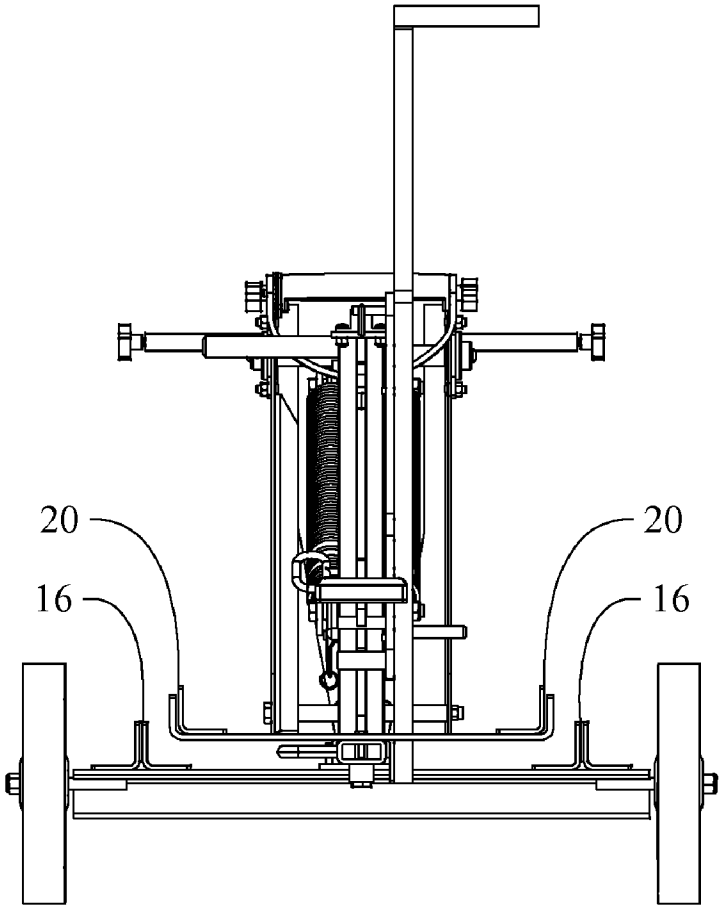
FIG. 32 is a rear plan view thereof.
Figure 33:
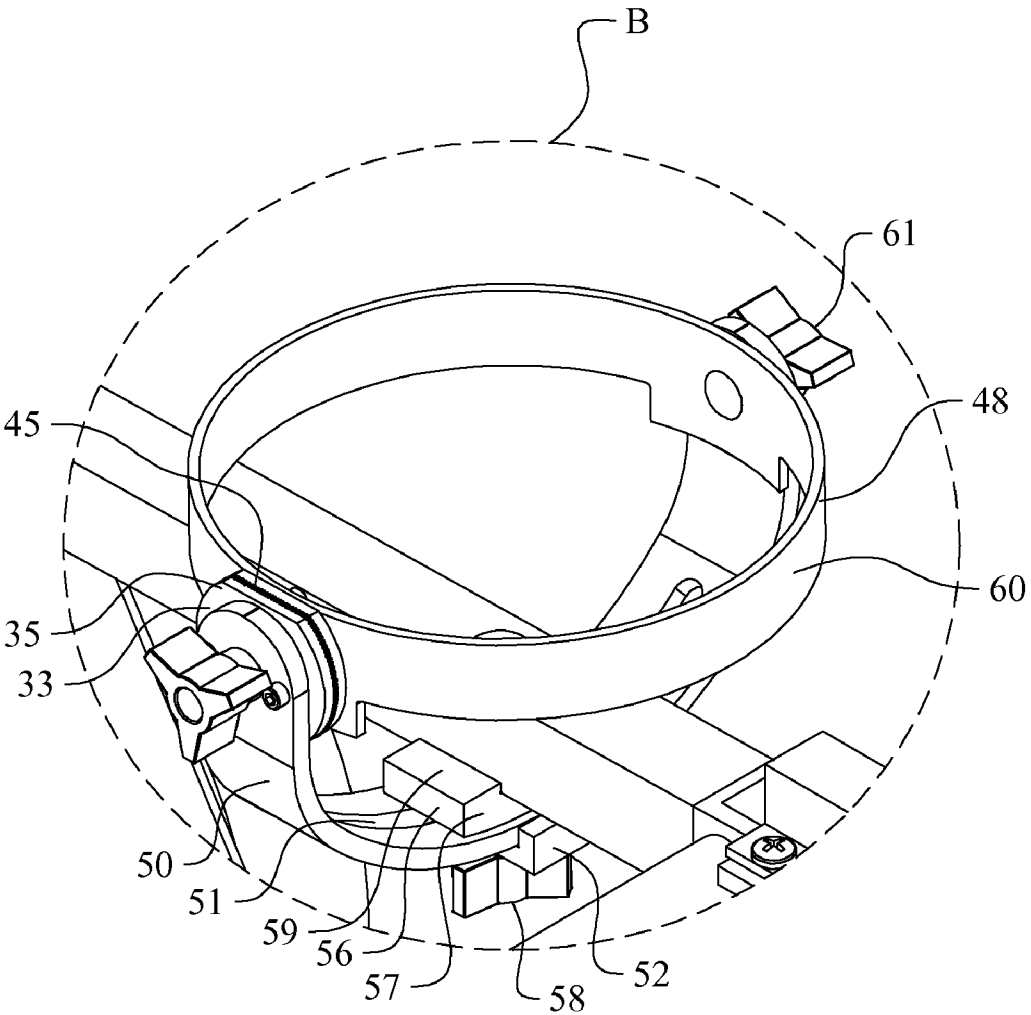
FIG. 33 is an enlarged fragmentary view as taken along section B of FIG. 24 showing the ball mount.
Figure 34:
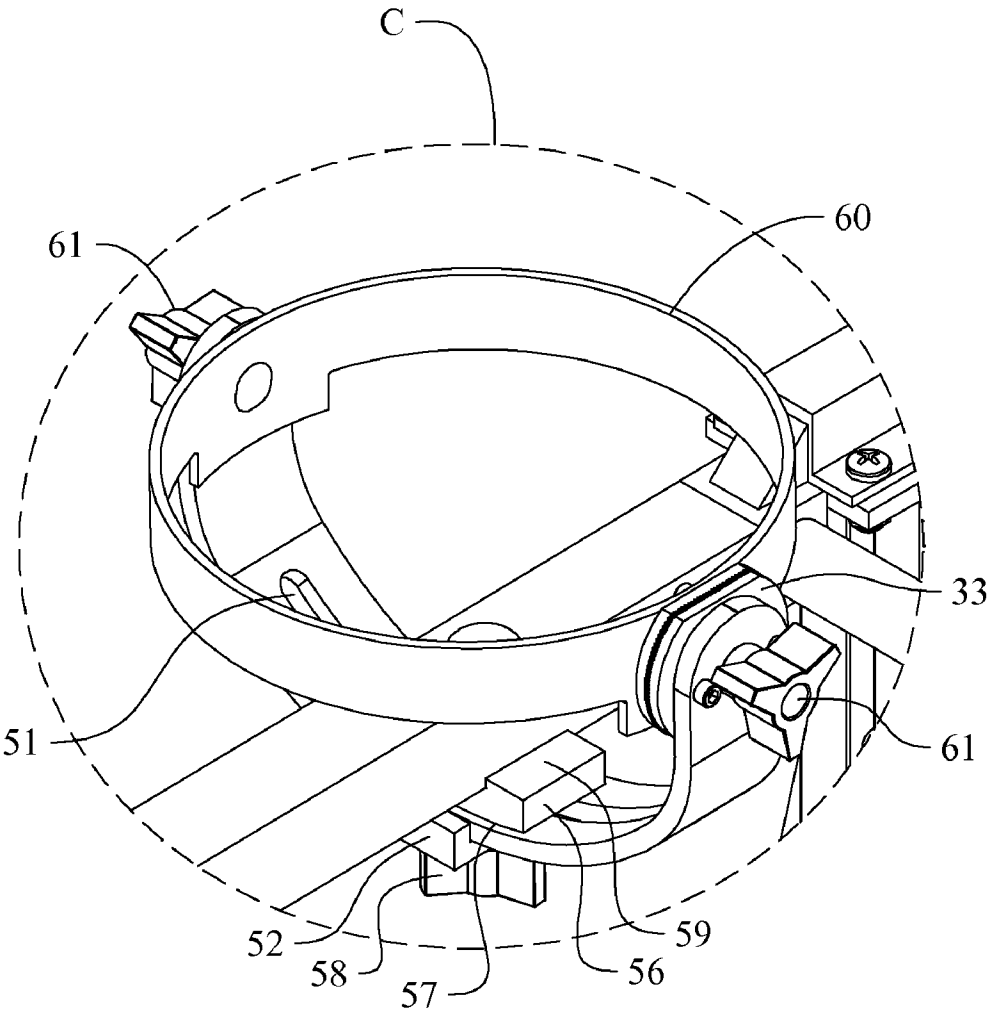
FIG. 34 is an enlarged fragmentary view as taken along section C of FIG. 25 showing the ball mount.
Figure 35:
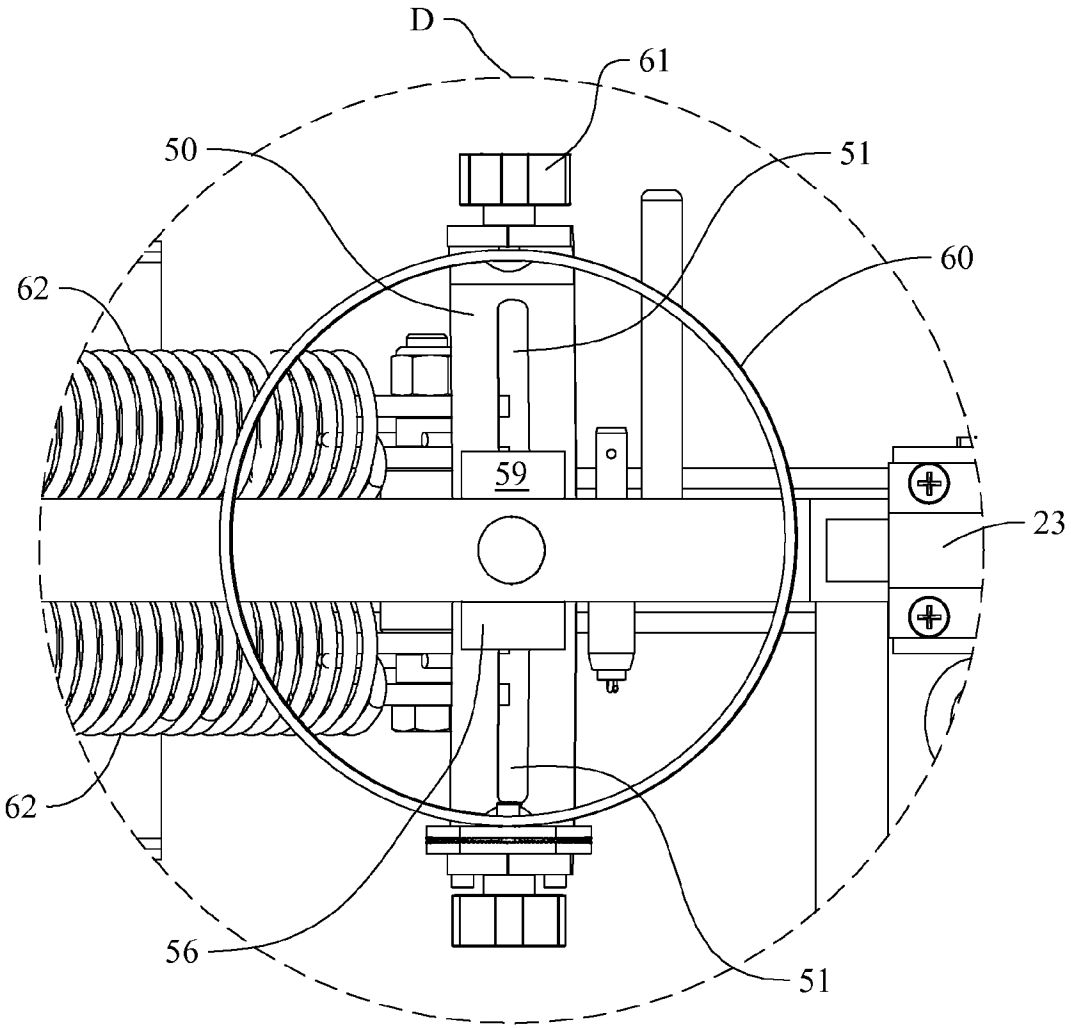
FIG. 35 is an enlarged fragmentary view as taken along section D of FIG. 30 showing the ball mount.
Figure 36:
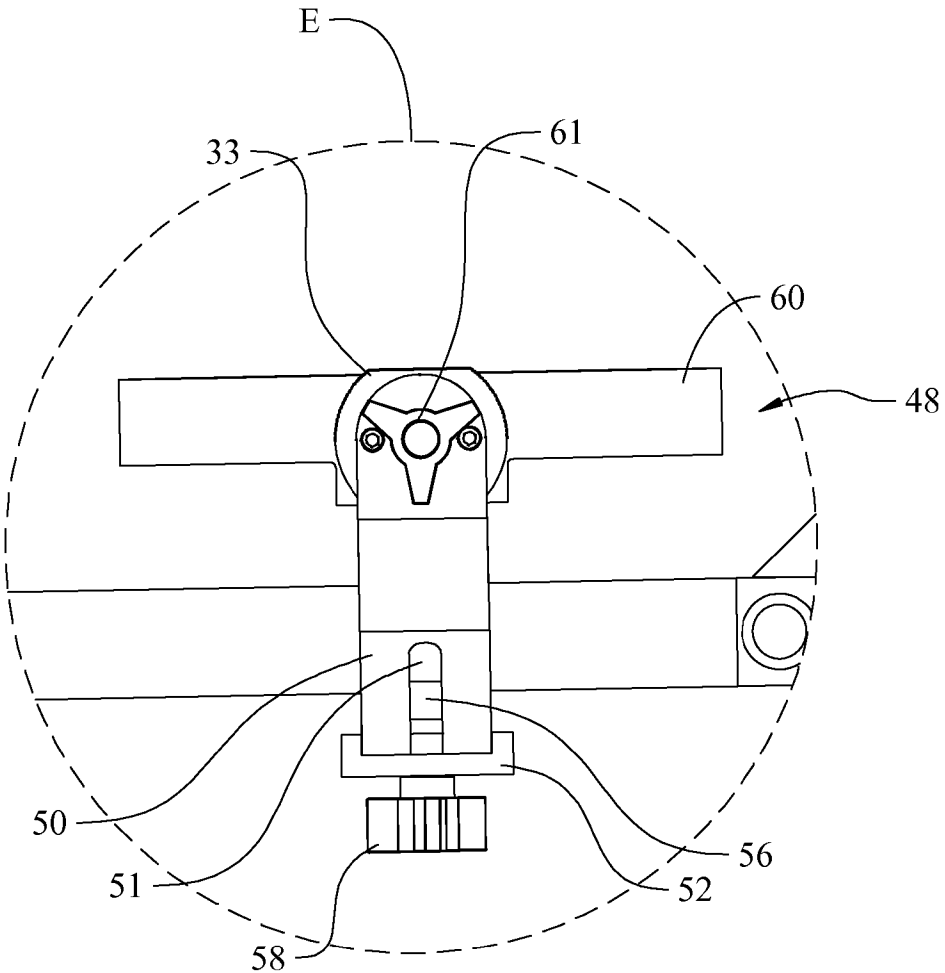
FIG. 36 is an enlarged fragmentary view as taken along section E of FIG. 27 showing the ball mount.

The preferred embodiment of the present art ball projecting and training apparatus 10 first comprises a base 11 having a front portion 12, a rear portion 18 and one or more wheels 14 pivotally mounted near or with said front portion 12. Alternative embodiments may forego use or not utilize said wheels 14 or utilize said front portion 12 without said wheels 14. For the preferred embodiment, the front portion 12 is a structural member attached with said base 11 via a bolt or screw with one or more indexed positions whereby the front portion 12 may be rotated, removed, and/or secured relative to said base 11. That is, the front portion 12 has one or more indexing holes 170 into which one or more pins 174 from a U-clamp 172 fitted over the base 11 extend into the holes 170 of the front portion 12 and lock the front portion 12 into position when a bolt or screw is tightened there through.

One or more guards 70 are preferably removably mounted with said base 11 upon or with one or more guard mounts 16 near said front portion 12 and one or more guard mounts 20 near said rear portion 18. Alternative embodiments may forego use of said guard mounts 20 or place said guard mounts 20 at a plurality of locations on said apparatus 10. Also for the preferred embodiment, a release support 22 is attached with said base 11, preferably closer to said rear portion 18 than said front portion 12, and projects upward, away from, or substantially perpendicularly from a plane substantially defined by said base 11. One or more throwing arm supports 38, each having a lower portion 39 and an upper portion 41, are attached with said base 11 near or at said lower portion 39. Said throwing arm supports 38 are preferably positioned closer to said front portion 12 than said rear portion 18, and also extend upward, away from, or substantially perpendicularly from a plane substantially defined by said base 11. Also for the preferred embodiment, one or more support braces 43 are attached between the throwing arm supports 38 and said base 11 and provide additional strength and support for said throwing arm supports 38. For the preferred embodiment, said supports 38 and said braces 43 are formed from a single sheet metal portion on each side which is bent and formed into a structure which mounts with the base 11. Alternative embodiments may utilize throwing arm supports 38, with or without said support braces 43, and release supports 22 which have a plurality of cross sectional shapes, sizes, and orientations.

A directing arm 40 is further attached with said base 11 and provides user control of the ball 74 projection direction for the apparatus 10 via a pivot or rotation of the apparatus 10 or base 11 on said wheels 14. That is, the rear portion 18 may be raised via said directing arm 40 and the apparatus 10 may be pivoted on the wheels 14. For the preferred embodiment, the directing arm 40 is mounted with said base 11 near or at said rear portion 18 and is an upright structural member which is bent or cants toward said rear portion 18 of said base 11 with a lateral extension for the user to grasp. A carrying or transportation handle 168 or extension is further mounted with said base 11 near or at said rear portion 11 in the form of a loop whereby the user may move the apparatus 10 as desired. As described herein, the term "attached" includes a plurality of generally accepted connecting and joining techniques as understood within the mechanical arts, including but not limited to welds, bolts, screws, pins, press fits, sweat fits, and removable mating and joining techniques.

For the preferred embodiment, a throwing arm 42 is pivotally mounted with said one or more throwing arm supports 38 near or at said upper portion 41 of the throwing arm supports 38. The throwing arm 42 preferably comprises a first end 44, a second end 46, and an arm pivot 66 between said first end 44 and second end 46, preferably closer to said second end 46. Said arm pivot 66 is a shaft which extends from said throwing arm 42 and pivotally mounts or interfaces with said throwing arm supports 38 in the preferred embodiment. For the preferred embodiment, said arm pivot 66 mates on each side with bearings 37 mounted with each of said arm supports 38. The bearings 37 in conjunction with said supports 38 retain the rotational or pivoting motion of the throwing arm 42 during operation and use of the apparatus 10. Alternative embodiments may utilize a plurality of mechanically accepted methods in order to provide a pivotal mount or interface of said throwing arm 42 with said arm supports 38, including but not limited to bearing interfaces, torsion bars, spring supports, and through shafts. Also, one or more spacers may be placed onto or over said pivot 66 to assure placement and positioning of the throwing arm 42 between the throwing arm supports 38.

A throwing arm handle 53 is mounted onto said throwing arm 42 near or at said first end 44. The throwing arm handle allows for easy and convenient cocking or retraction of the throwing arm 42, especially when stressed or biased by the energy storage elements 62. Said handle 53 preferably extends away from the throwing arm 42 at a location which is easily reachable by a user. The handle 53 may be attached to said throwing arm 42 via a plurality of methods including but not limited to welds, bolts, pins, or integral formation with the throwing arm 42.

A ball mount 48 is adjustably mounted with said throwing arm 42 near or at said first end 44 and is sized to accept or fit the ball 74 size utilized or desired by the user or player for a type of game. For the preferred embodiment, the ball mount 48 comprises a mount support bracket 50 which is pivotally or slidably connected with a ball retainer 60. The support bracket 50 is of an arcuate shape and preferably has one or more slots 51 there within through which a bracket fastener 58, such as a bolt, pin or clip, may be placed and by which the bracket 50 may be attached, adjusted or partially canted relative to the lengthwise axis of the throwing arm 42. Said slot 51 may also take the form of one or more holes within said bracket 50. The lengthwise axis is described as a line between the first end 42 and the second end 46 and the cant may be parallel with, perpendicular to, or a combination thereof relative to the lengthwise axis. For the preferred embodiment, the bracket fastener 58 clamps or compresses and attaches the support bracket 50 with said throwing arm 42. The support bracket 50 preferably has an arcuate shape or form whereby the bracket 50 substantially follows or is sized to accommodate the contours of the ball 74 and the throwing arm 42 is mounted within or external to the arcuate shape or form. Alternative embodiments of the support bracket 50 may take a plurality of forms including but not limited to linear, partial or full elliptical, and other partial or full polygonal forms. Also for the preferred embodiment, a spacer 56 having a radius side or arcuate portion 57 and a flat side or substantially flat portion 59 is sandwiched between the throwing arm 42 and the support bracket 50, all on the back side 49 of the throwing arm 42. The spacer 56 assures a positive mate of the support bracket 50 and the throwing arm 42 when the bracket fastener 58 is tightened or engaged. That is, for a screw or bolt bracket fastener 58, the bolt or screw is mated with female threads on the throwing arm 42 and rotated to sandwich the spacer 56 between the support bracket 50 and throwing arm 42, thereby holding the three elements 42, 50, 56 together. Also for the preferred embodiment, a notch or groove equivalent to or greater than the width of the throwing arm 42 is optionally placed onto the flat portion 59 of the spacer 56 in order to assure a positive mating with the throwing arm 42. Alternative embodiments may place said support bracket 50 and spacer 56 on the front side 47 of the throwing arm 42

The preferred embodiment support bracket 50 also has an outer clamp 52 which is placed between said bracket 50 and said bracket fastener 58 whereby said support bracket 50 is sandwiched between said spacer 56 and said outer clamp 52 as said fastener 58 holds the sandwich. Said outer clamp 52 is preferably of a "U" shaped form with a distance between the legs of the "U" of equal or greater distance than a width of the portion of the mount support bracket 50 between the spacer 56 and said outer clamp 52. Alternative embodiments may utilize a substantially flat outer clamp 52 or an outer clamp 52 having a plurality of shapes which mate and contour to said support bracket 50.

The ball retainer 60 is held or retained with the support bracket 50 via one or more ball retainer fasteners 61. In its preferred form, the ball retainer 60 also represents an arcuate shape or form which substantially follows or is sized to accommodate the contours of the ball 74. For the preferred embodiment, the ball retainer fasteners 61 allow the ball retainer 60 to pivot around an axis which is substantially perpendicular to, parallel with, or a combination thereof relative to the lengthwise axis of the throwing arm 42. When tightened or secured, the fasteners 61 fix the position of the ball retainer 60 and prevent further pivoting. As can be surmised from a review of the drawings in conjunction with the aforesaid description, the canting adjustability of the support bracket 50 in conjunction with the pivot adjustability of the ball retainer 60 allows a plurality of lateral and longitudinal or linear forces to be placed upon the ball 74 when the arm is activated (i.e. the ball 74 is accelerated by the apparatus 10). The location and extent of the placed forces affect ball 74 trajectory, elevation, yaw, pitch, and spin as the ball 74 exits the apparatus 10. That is, by allowing the vectorial summation of the aforesaid forces which are placed upon the ball 74 to be outside of the center of gravity of the ball 74, the trajectory and spin of the ball 74 is affected in a repeatable fashion.

For the preferred embodiment, the ball mount 48 has a serrated or grooved interface 33 between the mount support bracket 50 and the ball retainer 60 which allows the ball retainer 60 to be locked into position or retained in a position with said mount support bracket 50. Said interface 33 comprises a first locking disk 35 mounted with said support bracket 50 and a second locking disk 45 mounted with said ball retainer 60. Each locking disk 35, 45 has a plurality of serrations or grooves which are cut or formed to mate or bind with each other and lock the ball retainer 60 in a fixed position relative to the mount support bracket 50 when the retainer fastener 58 is tightened. Each locking disk 35, 45 is preferably attached with the respective bracket 50 or retainer 60 via screws or other fasteners with alternative embodiments utilizing a plurality of fastening forms including but not limited to welds, solders, integral formations, or pins.

The ball retainer 60 may take a plurality of forms including but not limited to a round or circular form, a partially circular form, an elliptic form, a partially elliptic form, or any other form which retains the ball 74 in position during the process of launching the ball 74. In the preferred embodiment, the ball retainer 60 and the mount support bracket 50 are formed from a flat stock material which is rolled, bent, or formed into the aforesaid forms. Alternative embodiments may form said ball retainer 60 and the mount support bracket 50 in a plurality of fashions, including but not limited to casting, machining, molding, or rapid prototyping techniques such as stereolithography.

An alternative embodiment ball mount 48 comprises a ball mount 48 mounted on the front side 47 of the throwing arm 42 near or at the first end 44. The alternative embodiment comprises a spacer 56 which has the form of a disk with an arcuate portion 57 and a substantially flat portion 59 between the throwing arm 42 and the mount support bracket 50. The spacer 56 disk allows the support bracket 50 or cradle to fit or mate with said arcuate portion 57 and be rotated or adjusted a full 360° for enhanced ball 74 trajectory control. The support bracket 50 is held with a bracket fastener 58 as with the preferred embodiment with the exception that the bracket fastener 58 transitions from the back side 49 through the throwing arm 42 to the front side 47 where it fastens with a nut, retainer, or other threaded portion of the support bracket 50. The support bracket 50 is geometrically equivalent to the preferred embodiment support bracket 50 with the variation as observed within the drawings. That is, it is of an arcuate shape, with one or more slots 51, and sized or shaped to accommodate the contours of the ball 74.

The alternative embodiment also has a ball retainer 60 held or retained with the support bracket 50 via one or more ball retainer fasteners 61. The alternative embodiment ball retainer 60 is also of a substantially arcuate shape or form which substantially follows or is sized to accommodate the contours of the ball 74. The alternative embodiment shown utilizes a substantially arcuate shape in the form of a circular ring. The alternative embodiment ball retainer 60 pivots, cants, and functions as the preferred embodiment to provide a plurality of lateral and longitudinal or linear forces upon the ball 74 when the arm 42 is activated (i.e. the ball 74 is accelerated by the apparatus 10). The location and extent of the placed forces affect ball 74 trajectory, elevation, yaw, pitch, and spin as the ball 74 exits the apparatus 10. For all embodiments, one or more graduations, markers, or indices 63 are placed upon one or more of the following: the spacer 56, the throwing arm 42, or the support bracket 50 or other elements as desired by the user. The graduations, markers, or indices 63 allow the user to set the apparatus 10 at a repeatable trajectory, yaw, pitch, and spin setting. This repeatability allows a coach or trainer to follow a guidebook with specific settings directed to a practice routine for a particular player or set of players and also record specific settings which are desirable.

For the preferred embodiment, near or at said second end 46 of said throwing arm 42 one or more energy storage elements 62 (such as a spring) are pivotally or flexibly mounted or connected between the accelerator 28 and said throwing arm 42. For the preferred embodiments, the energy storage elements 62 fully dissipate any stored energy into the throwing arm 42 via pivotal displacement of the throwing arm 42 and do not provide any tension to the throwing arm 42 when the apparatus 10 is not in a cocked or set position. The energy storage element 62 is mounted with an arm connector 64 such as a shaft through or on the throwing arm 42 or with a hook, loop, or hole mounted with the throwing arm 42. For the preferred embodiment, the arm connector 64 comprises one or more ears 65, preferably two, extending from the back side 49 of the throwing arm 42 with one or more holes 67 therein through which a bolt 69 may be placed. The bolt 69 is placed through the ends of the energy storage elements 62 with washers 75 on each side of the ends of the energy storage elements 62. Preferably said washers 75 or at least a portion of said connectors 64 are of an acoustic, vibration, or energy absorbent material such as a rubber or polymer material. Said material includes but is not limited to polyoxymethylene (i.e. Delrin), natural and synthetic rubbers, or any other material which has vibration absorbing properties. Alternative embodiments may utilize washers 75 of any metallic or rigid material which is able to withstand the energy storage element 62 forces. Further alternative embodiments may utilize one or more arm connectors 64 of an arbitrary shape and material which is capable of securing an end of the energy storage elements 62 with the throwing arm 42.

The energy storage element 62 transitions to and pivotally mounts with an accelerator 28 (or power pedal accelerator) storage element connector 32 in the form of a shaft or a hook, loop, or hole through or on the accelerator linkage 30. For the preferred embodiment, the accelerator storage element connector 32 comprises a slide assembly 135 having an internal passage 136 or bore which is able to slidably mount around or onto the accelerator linkage 30. The slide assembly 135 has a slide pin 138 which interfaces and attaches or secures the slide assembly 135 with the accelerator 28 or accelerator linkage 30 speed adjustment connection locations 34, preferably in the form of holes within the linkage 30. The preferred embodiment of the slide assembly 135 has a hole 137 through the assembly through which said slide pin 138 may be placed and an extending slide handle 140 which allows easy adjustment or movement of the slide assembly 135. A slide connector 141 having a through hole is mounted or connected with said slide assembly 135, preferably via welding, and a bolt or pin 144 is placed there through to secure the energy storage elements 62 to the slide assembly 135. Said slide connector 141 may take a plurality of forms including but not limited to holes within said slide assembly 135, "U" bolts mounted with said slide assembly 135, or other elements having a through hole or area which are attached to said slide assembly 135 via an integral formation, fasteners, welds, or adhesives. Preferably said energy storage elements 62 have two or more washers 143 at said slide assembly which sandwich the ends of the elements 62 and through which said bolt or pin 144 is placed to connect the elements 62 with said slide connector 141. Preferably, said washers 143 or a portion of said slide connectors 141 are also of an acoustic, vibration, or energy absorbent material such as a rubber or polymer material. Said material includes but is not limited to polyoxymethylene (i.e.

Delrin), natural and synthetic rubbers, or any other material which has vibration or energy absorbing properties. Alternative embodiments may utilize washers or slide connectors 141 of any metallic or rigid material which is able to withstand the energy storage element 62 forces. Alternative embodiments may utilize a plurality of energy storage element 62 forms, including but not limited to elastic bands, bungee type cords, pneumatic cylinders or air bags, and leaf, coil, or torsional springs. Where bolts 69, 144, are described relative to the energy storage elements 62 within the present application, as understood by one of ordinary skill within the art, pins, hooks, holes, or other extensions may be utilized to connect the energy storage elements 62 to the respective other elements.

The accelerator 28 provides additional force to the throwing arm 42 when the user desires such and also makes cocking or setting of the apparatus 10 easier as the energy storage element(s) 62 presents a smaller force when not fully extended or stretched. That is, as expressed by Hooke's law, an elastic energy storage element exhibits a force represented as $F=kx$ where k is the spring constant of the elastic energy storage element and x represents the displacement from nominal or equilibrium. Thus, when the energy storage element(s) 62 is displaced less, a smaller cocking or setting force is presented to the user.

The accelerator 28 comprises a linkage 30 pivotally connected or attached with the throwing arm supports 38, the base 11, or other structural elements of the apparatus 10 and has one or more speed adjustment connection locations 34. Said linkage 30 extends toward said rear portion 18 of said base 11. Said accelerator 28 is preferably pivotally mounted between said base 11 and said throwing arm 42. For the preferred embodiment, a pivot 36 in the form of a shaft 146 is placed through the lower portion 39 of the throwing arm support(s) 38 and the linkage 30. Said shaft 146 is in the form of a bolt in the preferred embodiment but may take a plurality of shaft forms as understood within the arts, including but not limited to round stock, square stock, pins, or tubes. The preferred embodiment further has one or more spacers 148 on each side of the accelerator 28 between the accelerator 28 and the throwing arm supports 38 in order to ensure positioning. Alternative embodiments may utilize accelerators 28 or pivots 36 with a plurality of shapes and forms as recognized within the mechanical arts provided the displacement of the energy storage element(s) 62 is adjustable by the user when desired. The speed adjustment connection locations 34, preferably one or more holes within the accelerator 28 linkage 30, allow the energy storage element(s) 62 to be mounted with the accelerator 28 at one or more positions which provide a greater or lesser displacement to the energy storage element (s) 62, and thereby a greater or lesser throwing arm 42 force or energy. The speed adjustment connection locations 34 of said accelerator 28 may take a plurality of forms, including but not limited to holes, hooks, arms, notches, or compression holds. Preferably one or more removable pins 144 are utilized through said speed adjustment connection locations 34 to secure said energy storage element(s) 62, with alternative embodiments utilizing a plurality of accepted joining or connection methods including but not limited to bolts, catches, and detents. Also for the preferred embodiment, the accelerator 28 is foot adjustable or actuated. Foot adjustability allows the substantial leg force available from the user to impart a significant amount of energy to the energy storage element(s) 62 as said energy storage element(s) 62 is/are displaced. Alternative embodiments may utilize a plurality of methods to displace said energy storage element(s) 62 including but not limited to pneumatic and hydraulic actuators, motors, and worm screws.

For the preferred embodiment, the release support 22 represents a structure which guides the linkage 30 and has one or more accelerator holes 150 within or there through for accelerator 28 height adjustment. An accelerator pin 152 is placed within or there through in order to control or adjust the accelerator 28 height or displacement. As discussed relating to Hooke's law, the more displacement allowed onto the energy storage elements 62, the more energy imparted to the ball 74 upon release. The accelerator pin 152 limits the displacement of the accelerator 28 by limiting its displacement relative to the base 11 and thereby limits the potential amount of energy imparted to the ball by the accelerator 28. The release support 22 structure is preferably formed from two square steel posts between which is located the linkage 30 within the preferred embodiment but may take a plurality of upright structural forms which guide the linkage 30 such as rounds, squares, tubes, or posts and which may be formed from a plurality of materials including but not limited to metals, composites, polymers, and woods. The preferred embodiment release support 22 further has a base support 176 in the form of a trapezoidal member at the interface between the base 11 and the support 22 and between the steel posts which, when attached with the base 11 and support 22, provides further strength and support. The accelerator 28 height or displacement may be controlled by a plurality of other mechanical elements or techniques including but not limited to latches, stops, screws, or rails.

A release 23 or latch is mounted with said release support 22 and, for the preferred embodiment, comprises a slidable release block 24 or sear which fits over or with and holds said throwing arm 42 when the throwing arm 42 is in a cocked or set position. Also for the preferred embodiment, a release linkage 26 is pivotally mounted with said release support 22 and attached with said release block 24. The linkage 26 extends the release block 24 actuation or apparatus 10 triggering to near or at the user's foot. That is, near the base 11 of the apparatus. For the preferred embodiment, the release linkage 26 has a release extension 27 opposite said release block 24 near said base 11 which is contacted by said accelerator 28 linkage 30 when said accelerator 28 is fully depressed. That is, the accelerator is able to impart energy to the energy storage elements 62 and trigger the apparatus 10 in a single movement or stroke. One or more release springs 29 or energy storage elements are placed between the release linkage 26 and the release support 22 in order to bias the release 23 closed and prevent accidental discharge. A spring or storage element may also or in lieu of said release spring 29 be mounted internal to the release 23 or latch. Alternative embodiments may utilize a plurality of release methods for holding said throwing arm 42 in a cocked position and triggering the apparatus 10, including but not limited to pins, latches, magnetic latches, cords, or hooks. Alternative embodiments may further utilize a plurality of linkage 26 forms which are mounted at a plurality of locations on said apparatus 10 or utilize a cord in lieu of said linkage 26.

Also for the preferred embodiment, a safety assembly 154 or lock is pivotally mounted with said release support 22 and serves to prohibit unintended discharge of the apparatus 10 until such time as the accelerator 28 is depressed or displaced. The safety assembly 154 comprises a safety arm 156 pivotally mounted upon a pivot shaft 160 attached with said release support 22. The safety arm 156 has a safety spring 162 or other elastic element connected thereto and to the release support 22. The safety arm 156 also has one or more safety arm extensions 158 which extend from said arm 156 and block movement of the release linkage 30. That is, the safety spring 162 biases or positions the safety arm 156 whereby said extension 158 blocks the triggering movement of said release linkage 26. When the accelerator 28 linkage 30 is displaced toward the base 11, the linkage 30 contacts said extension 158 or safety arm 156 and moves the safety assembly 154 out of a blocking position relative to said release linkage 26. This allows the release linkage 26 to be displaced and trigger a launching of the ball 74. Placement of the extension 158 on said safety arm 156 is away from or substantially opposite said pivot shaft 160 in such a position that said safety arm 156 is capable of blocking movement of the release linkage 30. Alternative embodiments of the safety assembly 154 may utilize a plurality of generally accepted forms, including but not limited to latches, catches, hooks, or frictional contacts provided said safety assembly 154 prohibits unintended discharge of the apparatus 10.

As described, the preferred embodiment has one or more attachable and removable safety guards 70 which substantially cover the sides, rear, and front of the apparatus 10 and prevent unwanted, inadvertent, or unsafe interference with the apparatus 10 or throwing arm 42 operation. For the preferred embodiment, the guards 70 are of a rigid sheet material such as a polymer, fiberglass, composite, metal, or wood which are cut into a shape which substantially isolates the user from the mechanisms of the apparatus 10. The guards 70 are attached with the base 11 via one or more guard mounts 16 in the form of slots formed with the front portion 12 of the apparatus 10 and guard mounts 20, also in the form of slots, formed with or near the rear portion 18 of the apparatus 10. The guards 70 are attached with the throwing arm supports 38 via one or more guard extensions 164 which are attached with and extend from the throwing arm supports 38 and allow a guard fastener 166 to be placed through the guard 70 and into the guard extension 164 or simply in the form of a nut attached with the guard extension 164 as it protrudes through the guard 70. The guard fastener 166 is in the form of a bolt or nut within the preferred embodiment but may take a plurality of other forms including but not limited to pins, latches, magnetic holders, screws, or frictional fits. For the preferred embodiment, the guard mounts 16, 20 are formed from two or more bends or substantially bent members placed closely together to form a slot which is the same or greater than the thickness of the guard 70 material. Nearest the front portion 12, said guard 70 is preferably a flexible mesh material which is attached with the remaining rigid guard 70 material and flexes when or if impacted by said throwing arm 42. Nearest the rear portion 18, said guard 70 is preferably attached with the remaining guard 70 material via one or more hinges with slots for the linkage 30 and the directing arm 40. This allows for easy and convenient removal of the guard 70 from the apparatus 10 when desired or necessary. For an alternative embodiment, the guards 70 preferably comprise a frame 71 with a flexible covering 73 which mounts within the guard mounts 16, 20. Alternative embodiments may utilize guards 70 having a plurality of shapes, styles, and constructions including but not limited to meshes, screens, vinyl coverings, or solid panels.

For an alternative embodiment, a ball storing and feeding structure 72 is mounted with a frame of said guards 70 and extends laterally from the apparatus 10. The ball storing and feeding structure 72 allows a plurality of balls 74 to be stored adjacent the apparatus 10 for quick and easy access by the user. The preferred ball storing and feeding structure 72 comprises two parallel members 80 which are sloped or canted slightly towards the apparatus 10 with extending legs 78 which mount with a frame of said guards 70 and rest upon the surface adjacent said apparatus 10. A ball stop 76 prevents the balls 74 from rolling into or onto the apparatus 10 and interfering with apparatus use 10.

In operation, the user first adjusts the ball throwing distance by moving the portion of the energy storage element 62 at the accelerator storage element connector 32 to the speed adjustment connection location 34 desired. For the preferred embodiment, this is achieved by removing the slide pin 138 from the slide assembly 135 and accelerator 28 linkage 30, sliding the slide assembly 135 to a desired location, and placing said slide pin 138 through the slide assembly 135 and linkage 30. For an alternative embodiment this is achieved by removing a pin from a hole within the accelerator 28 linkage 30 and moving it to another location. The user then begins the ball 74 yaw or roll adjustment by loosening the bracket fastener 58, moving the mount support bracket 50 to a desired orientation, and re-tightening the bracket fastener 58. The alternative embodiment mount support bracket 50 as shown allows the mount support bracket 50 to rotate substantially 360° and thereby be positioned at a plurality of angles (by utilizing said slot 51) which are either in line, perpendicular to, or a combination thereof relative to the throwing arm 42. This allows user creation of a direct ball 74 shot, a high lobbing ball 74 shot, or any combination thereof.

The user then loosens the ball 74 retainer fastener 61, adjusts the ball retainer 60 for a desired pitch or trajectory, and re-tightens the ball 74 retainer fastener 61. The serrated or grooved interface 33 locks together after said fastener 61 is tightened, thereby assuring a positive and repeatable ball 74 trajectory. (It is important to note that the pitch and cant or swerve adjustments maybe found on either the mount support bracket 50 or the ball retainer 60 depending upon the orientation of the attachment of the ball mount 48 with the throwing arm 42, i.e. inline, perpendicular, or a combination thereof.) The user will obviously utilize the graduations, markers, or indices 63 in order to reproduce a previously documented ball 74 shot or to record a desired ball 74 shot. The user may at any time utilize the directing arm 40 to position the apparatus 10 toward a desired launch direction.

Once fully adjusted, the user cocks, sets, or preloads the throwing arm 42 of the apparatus 10 by rotating the throwing arm 42 on the arm pivot 66 until it engages and is held by the release block 24 or sear. The ball 74 is then loaded into the ball mount 48 and the apparatus 10 is ready for ball 74 launch. If the user desires a greater velocity or distance shot, he or she presses the accelerator 28 or power pedal, preferably with his or her foot. For the preferred embodiment, when the accelerator 28 is depressed, the safety assembly 154 releases and allows the accelerator 28 linkage 30 to trigger ball 74 launch when fully depressed. When ball 74 launch is desired, the user activates the release linkage 26, preferably with his or her foot or via the accelerator 28, the release block 24 or sear disengages from the throwing arm 42, and the energy storage elements 62 dissipate their stored energy into ball movement by moving the throwing arm 42 through an arc. The user repeats the aforesaid process through the practice or drill session.

The art of the present invention may be manufactured from a plurality of materials including but not limited to metals and alloys thereof, plastics, composites, or ceramics without departing from the scope and spirit herein intended. The apparatus may further be manufactured via molding, machining, casting, forging, pressing, laminating, carving, or utilization of stereo-lithographic or electro-dynamic milling or other techniques which are appropriate for the material utilized. For the preferred embodiment, the base 11 is manufactured from a steel material and the throwing arm 42 and ball mount 48 are manufactured from an aluminum material.

Although described for enablement purposes, the lengths, widths, geometric shapes, and other dimensional attributes may depart significantly from those specified. The shape, size, location, component numbers, and mounting methods utilized for the components described may take a plurality of forms as recognized within the pertinent arts without departing from the scope and spirit of the present invention.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. A ball projecting and training apparatus, comprising:

a base having a front portion, a rear portion, a release support attached with and projecting from said base, and one or more throwing arm supports attached with and projecting from said base; and said throwing arm supports having a lower portion nearest said base and an upper portion; and a throwing arm having a first end, a second end, a front side, a back side, and an arm pivot; and said arm pivot pivotally mounted with said throwing arm supports at or near said upper portion; and an accelerator pivotally positioned between said base and said throwing arm; and said accelerator having an accelerator linkage extending toward said rear portion of said base; and one or more energy storage elements attached with and between said accelerator and said throwing arm at or near said second end of said throwing arm and capable of providing an energy to said throwing arm; and a release attached with said release support capable of holding said throwing arm in a cocked or set position; and a ball mount having a mount support bracket and a ball retainer; and said ball mount sized to accept a ball; and said mount support bracket pivotally or slidably attached with said throwing arm near or at said first end of said throwing arm with one or more bracket fasteners; and said ball retainer having a shape which can accept said ball; and said ball retainer pivotally attached with said mount support bracket with one or more retainer fasteners; and said ball retainer retained in a fixed position relative to said mount support bracket via said retainer fasteners; and said ball mount imparting a linear acceleration, an angular acceleration, a spin, a yaw, or a pitch to said ball when said energy storage elements provide said energy to said throwing arm.

2. The ball projecting and training apparatus as set forth in claim 1, further comprising:

a serrated or grooved interface between said mount support bracket and said ball retainer which allows a locking of a position of said ball retainer with said mount support bracket.

3. The ball projecting and training apparatus as set forth in claim 2, whereby:

said serrated or grooved interface comprises a first locking disk mounted with said support bracket and a second locking disk mounted with said ball retainer.

4. The ball projecting and training apparatus as set forth in claim 3, further comprising:

one or more slots within said mount support bracket by which said mount support bracket may pivot or slide on said bracket fasteners relative to said throwing arm.

5. The ball projecting and training apparatus as set forth in claim 4, further comprising:

said mount support bracket having an arcuate shape; and a spacer having a radius side sandwiched between said throwing arm and said support bracket whereby a positive mate is formed when said bracket fastener is tightened or engaged.

6. The ball projecting and training apparatus as set forth in claim 1, further comprising:

one or more slots within said mount support bracket by which said mount support bracket may pivot or slide on said bracket fasteners relative to said throwing arm.

7. The ball projecting and training apparatus as set forth in claim 6, further comprising:

said mount support bracket having an arcuate shape; and a spacer having a radius side sandwiched between said throwing arm and said support bracket whereby a positive mate is formed when said bracket fastener is tightened or engaged.

8. The ball projecting and training apparatus as set forth in claim 7, whereby:

said spacer is sandwiched between said backside of said throwing arm and said support bracket.

9. The ball projecting and training apparatus as set forth in claim 7, further comprising:

two or more speed adjustment connection locations on said accelerator; and an accelerator storage element connector in the form of a slide assembly movably attached with one or more of said speed adjustment connection locations; and said energy storage element attached with said accelerator via said accelerator storage element connector; and a pivot mounted with said throwing arm and said lower portion of said throwing arm supports whereby said accelerator is pivotally positioned between said base and said throwing arm.

10. The ball projecting and training apparatus as set forth in claim 1, further comprising:

two or more speed adjustment connection locations on said accelerator; and an accelerator storage element connector movably attached with one or more of said speed adjustment connection locations; and said energy storage element attached with said accelerator via said accelerator storage element connector.

11. The ball projecting and training apparatus as set forth in claim 10, further comprising:

said accelerator storage element connector having a slide assembly with a passage which is able to slidably mount onto said accelerator linkage; and said slide assembly having a slide pin which secures said slide assembly with one or more of said accelerator speed adjustment connection locations.

12. The ball projecting and training apparatus as set forth in claim 11, further comprising:

a pivot mounted with said throwing arm and said lower portion of said throwing arm supports whereby said accelerator is pivotally positioned between said base and said throwing arm.

13. The ball projecting and training apparatus as set forth in claim 12, further comprising:

a release linkage attached with said release and pivotally mounted with said release support; and a release extension attached with said release linkage; and a safety assembly having a safety arm pivotally attached with said release support; and a safety arm extension extending from said safety arm at a position to block said release linkage; and said safety arm extension further at a position to contact said accelerator linkage if said accelerator is displaced and unblock said release linkage; and said release extension positioned to contact said accelerator linkage if said safety arm extension is first contacted with said accelerator linkage; and said release extension allowing said accelerator linkage to actuate said release via said release linkage thereby allowing said energy storage elements to provide said energy to said throwing arm.

14. The ball projecting and training apparatus as set forth in claim 13, further comprising:

two or more wheels pivotally mounted with said front portion of said base; and a directing arm mounted with said base near or at said rear portion; and said directing arm allowing a control of said ball projection via a rotation of said base on said wheels.

15. The ball projecting and training apparatus as set forth in claim 14, further comprising:

one or more attachable and removable safety guards attached with said base; and said safety guards positioned to prevent an unwanted, an inadvertent, or an unsafe interference with said throwing arm.

16. The ball projecting and training apparatus as set forth in claim 15, further comprising:

a slide connector attached with said slide assembly; and said slide connector attached with one or more of said energy storage elements; and an arm connector attached with said throwing arm second end; and said arm connector attached with one or more of said energy storage elements; and one or more portions of said arm connector or slide connector comprising an energy absorbing material.

17. The ball projecting and training apparatus as set forth in claim 1, further comprising:

a release linkage attached with said release and pivotally mounted with said release support; and a safety assembly mounted with said release support; and said safety assembly capable of a blocking of said release linkage and prohibiting said energy storage elements from providing said energy to said throwing arm unless said accelerator is displaced.

18. The ball projecting and training apparatus as set forth in claim 17, further comprising:

said safety assembly having a safety arm pivotally attached with said release support; and a safety arm extension extending from said safety arm at a position to block said release linkage; and said safety arm extension further at a position to contact said accelerator linkage if said accelerator is displaced and unblock said release linkage.

19. The ball projecting and training apparatus as set forth in claim 18, further comprising:

a release extension attached with said release linkage; and said release extension positioned to contact said accelerator linkage if said safety arm extension is first contacted with said accelerator linkage; and said release extension allowing said accelerator linkage to actuate said release via said release linkage thereby allowing said energy storage elements to provide said energy to said throwing arm.

* * * * *